US006076648A

United States Patent [19]

Hatamachi et al.

[11] Patent Number: 6,076,648

[45] Date of Patent: Jun. 20, 2000

[54] BILL PROCESSING DEVICE

[75] Inventors: Tadashi Hatamachi, Higashimatsuyama; Makoto Yamamoto; Mitsugu Mikami, both of Kawagoe, all of Japan

[73] Assignee: Kabushiki Kaisha Nippon Conlux, Tokyo, Japan

[21] Appl. No.: 08/910,668

[22] Filed: Aug. 13, 1997

Related U.S. Application Data

[62] Division of application No. 08/401,910, Mar. 10, 1995, Pat. No. 5,709,293.

[30] Foreign Application Priority Data

| | | | |
|---|---|---|---|
| Mar. 10, 1994 | [JP] | Japan | 6-39951 |
| Mar. 31, 1994 | [JP] | Japan | 6-63561 |
| Apr. 1, 1994 | [JP] | Japan | 6-65174 |

[51] Int. Cl.[7] ..... G07D 7/00

[52] U.S. Cl. ..... 194/206; 194/351

[58] Field of Search ..... 194/203, 206, 194/207, 351

[56] References Cited

U.S. PATENT DOCUMENTS

| | | | |
|---|---|---|---|
| 3,485,358 | 12/1969 | Hooker | 209/534 |
| 3,924,847 | 12/1975 | Pescetto | 194/202 |
| 3,937,926 | 2/1976 | Jones et al. | 194/210 |
| 3,966,047 | 6/1976 | Steiner | 209/534 |
| 4,045,017 | 8/1977 | Lundblad | 194/207 |
| 4,050,562 | 9/1977 | Schwippert et al. | 194/261 |
| 4,091,271 | 5/1978 | Jones et al. | 235/380 |
| 4,283,708 | 8/1981 | Lee | 194/206 |
| 4,348,656 | 9/1982 | Gorgone et al. | 194/213 |
| 4,470,496 | 9/1984 | Steiner | 194/200 |
| 4,513,439 | 4/1985 | Gorgone et al. | 194/206 X |
| 4,513,880 | 4/1985 | Mori et al. | 221/71 X |
| 4,540,081 | 9/1985 | Mori et al. | 209/534 |
| 4,556,139 | 12/1985 | Akagawa et al. | 194/207 |
| 4,585,125 | 4/1986 | Mori et al. | 209/534 |
| 4,628,194 | 12/1986 | Dobbins et al. | 209/534 |
| 4,678,072 | 7/1987 | Kobayashi et al. | 209/534 |
| 4,731,523 | 3/1988 | Kozima | 235/379 |
| 4,749,076 | 6/1988 | Akagawa et al. | 194/207 |
| 4,765,607 | 8/1988 | Zouzoulas | 271/177 |
| 4,775,824 | 10/1988 | Barnes et al. | 318/567 |
| 4,784,274 | 11/1988 | Mori et al. | 209/534 |
| 4,807,736 | 2/1989 | Kondo et al. | 194/206 |
| 4,809,966 | 3/1989 | Kobayashi et al. | 194/206 X |
| 4,858,744 | 8/1989 | Kolejs et al. | 209/534 |
| 4,880,096 | 11/1989 | Kobayashi et al. | 209/534 X |
| 5,005,688 | 4/1991 | Yukimoto et al. | 194/206 |
| 5,195,739 | 3/1993 | Watabe | 194/206 X |
| 5,209,335 | 5/1993 | Shuren et al. | 194/206 X |
| 5,209,395 | 5/1993 | Zouzoulas et al. | 271/181 X |
| 5,222,584 | 6/1993 | Zouzoulas | 209/534 |
| 5,254,841 | 10/1993 | Watabe et al. | 235/379 |
| 5,259,490 | 11/1993 | Gardellini | 194/203 |

FOREIGN PATENT DOCUMENTS

| | | | |
|---|---|---|---|
| 2-266491 | 10/1990 | Japan | 194/206 |

*Primary Examiner*—F. J. Bartuska
*Attorney, Agent, or Firm*—Diller, Ramik & Wight, PC

[57] ABSTRACT

If the number of returned bills is two or more, the returned bills are identified as abnormally returned bills by an abnormally returned bill detecter, and predetermined abnormal-state processing is accomplished by performing control operations using an abnormality processor. If a bill has jammed in the bill conveying channel, information concerning the direction in which the bill has jammed is stored in the bill jamming direction memory unit of the control unit, and, as a result of control operations performed by the bill reverse-direction conveyance control unit of the control unit, the bill is conveyed in the direction opposite to the bill jamming direction stored in the bill jamming direction memory unit when the bill jammed in the bill conveying channel is to be removed. A shutter that opens and closes the bill conveying channel is also installed and the shutter is driven via a gear transmission comprising a worm gear that develops considerable frictional force between the engaged gears and has a high reduction rate as viewed from the motor side, and a worm wheel that engages the worm gear.

2 Claims, 31 Drawing Sheets

BILL PROCESSING DEVICE

This application is a division of application Ser. No. 08/401,910, filed Mar. 10, 1995, now U.S. Pat. No. 5,709, 293 (status, abandoned etc.).

BACKGROUND OF THE INVENTION

1. Field of the Invention

This invention relates in general to a bill processing device used in automatic vending machines, change machines, pachinko ball dispensers, token dispensers, and various other types of automatic service equipment, and in particular to a bill processing device designed to reliably prevent bill extraction and other types of tampering. In addition, this invention relates in general to a bill processing device which conveys inserted bills along a bill conveying channel, and accepts and stores them in a bill receptacle, and in particular to a bill processing device in which bill removal operations are facilitated if bill jamming occurs in the bill conveying channel.

2. Description of Related Art

A bill processing device used in an automatic vending machine or other piece of automatic service equipment is configured in such a way that a bill inserted into a bill insertion slot is conveyed into the device using a conveyor belt driven by a conveying motor, and allowed to travel past the mounting position of a bill identification sensor; the bill identified as authentic based on the output from the bill recognition sensor is temporarily held (escrowed); the temporarily held bill (hereinafter "the escrow bill") is then returned to the bill insertion slot by the reverse rotation of the aforementioned conveying motor if a bill return command has been generated; and the escrow bill is deposited in a stacker if a stacking command has been generated.

In view of this, known structures adopted for conventional bill processing devices involved installing a lever-shaped shutter in the bill conveying channel to prevent the aforementioned escrow bills from being tampered with.

Specifically, this shutter is configured in such a way that it opens if a bill has been inserted into the bill insertion slot, and the bill conveying channel is blocked before it is established by the bill identification sensor that the bill is authentic, making any further manipulation of the temporarily held (escrowed) escrow bill from the bill insertion slot impossible.

The shutter of a conventional device, however, is shaped as a lever, and this shutter is configured in such a way that it is driven by a solenoid and operates under its own weight when the bill conveying channel is to be blocked, and this makes it possible to open the shutter easily by, for example, attaching a tape or the like to the bill, inserting the bill into the bill insertion slot, and pulling on the tape after the bill has been temporarily held (escrowed), and to subsequently take out through the bill insertion slot the escrow bill that has reached the escrowed state, or to perform other fraudulent acts.

To address this situation and to reliably prevent escrow bills from being tampered with, it has been proposed to employ bill processing devices configured in such a way that a shutter driven by a shutter motor is installed in the bill insertion slot, and the following operations are performed if it is detected that the shutter has been improperly opened or if it is detected that a bill temporarily held in the holding unit is moving backward:

(1) The shutter motor is again set into operation and is again driven in the direction of shutter closure, (2) The bill temporarily held in the holding unit is forcibly transported into a stacking unit and stacked there, (3) An amount equal to the value of the bill held in the holding unit is forcibly deducted from the inserted amount, (4) Bill acceptance is compulsorily prohibited during a certain time.

Such a structure, however, is still disadvantageous in that, for example, an altered bill that cannot be stacked in the stacking unit, such as a longitudinally cut-apart bill that has been joined together by means of tape or the like, is used; another bill is introduced following the altered bill; and an operation is performed in which the tape or other material connected to the bills is used to simultaneously pull out the subsequently introduced bill together with the altered bill by initiating, for example, a bill return operation after the altered bill has been stacked, with the result that stacking is improperly registered despite the actual absence of stacked bills in the stacking unit.

In addition, as a general rule, bill processing devices which determine whether or not the inserted bills are authentic, and accept and store only the bills identified as authentic are mounted inside the chassis of automatic vending machines and other types of bill handling equipment.

Such a bill processing device comprises a bill conveying unit that conveys the bills inserted into the bill insertion slot into the chassis of the device along a bill conveying channel, a data read unit that reads the data used to determine whether the conveyed bills are authentic or not, and a bill depository that accepts and stores the conveyed bills.

A disadvantage of the aforementioned conventional bill processing devices is that if a bill has jammed in the bill conveying channel, it is necessary to perform an operation which involves removing the jammed bill by opening or otherwise manipulating a part of the bill conveying channel, but it is in no way certain that a bill is present in the opened part of the bill conveying channel, and the bill removal operation is very time-consuming and impairs operability.

As a general rule, bill processing devices designed to determine the authenticity of the inserted bills and to accept and store only the bills identified as authentic are mounted inside automatic vending machines and other types of bill handling equipment.

Broadly classified, such bill processing devices comprise a bill conveying channel which is connected to the bill insertion slot and which guides the bills inserted into the bill insertion slot into the device, a bill recognition means for determining the authenticity of the conveyed bills, and bill receiving means for performing sequential collection and storage by forcibly pushing the bills identified as authentic into the stack.

Meanwhile, the present applicants, aiming at preventing the bills already inserted into the bill insertion slot from being forcibly extracted through the bill insertion slot, have previously proposed in Japanese Patent Application 5-276592 that the bill conveying channel connected to the bill insertion slot be equipped with a shutter means that forcibly opens and closes the bill conveying channel by the driving force of a motor, and that this shutter means close the bill conveying channel following the passage of the inserted bills and prevent the bills from being forcibly extracted through the bill insertion slot.

FIG. 35 is a general front view showing the shutter means 132 of the bill processing device previously proposed by the present applicants. The shutter means 132 comprises a first plate 150 secured to a front mask (described below) in which a bill insertion slot has been formed, and a second plate 152 supported in such a way that it can be slid in the vertical direction with respect to the first plate 150 by means of a rack-and-pinion mechanism 151.

A shutter 154 composed of multiple plates 153, which are embedded by varying the arrangements in a mutually different (staggered) manner, is mounted on the lower end 152*a* of the second plate 152, as shown in FIG. 36, which is a bottom view thereof.

Of these multiple plates 153, the plate 153*a* embedded in the center is shaped in an approximately doglegged cross section, and the other plates are shaped in approximately rectangular cross sections.

In addition, because the shutter 154 which consists of the multiple plates 153 is obtained by performing the embedding while varying the arrangements in a mutually different manner, the entire cross-directional region of the shutter 154 is covered by the plates 153 without leaving any substantial spaces in between when viewed from the front, as shown in FIG. 35.

Meanwhile, multiple holes 155*a* and 156*a* whose shapes correspond to the cross-sectional shapes of the multiple plates 153, as shown in FIG. 37, are formed in the upper and lower chutes 155 and 156 that form a bill conveying channel positioned opposite to the aforementioned shutter 154, in such a way that the multiple plates 153 that comprise the shutter 154 can each extend and retract.

According to the shutter means 132, as shown by a cross section of the main components of a front mask 122, when a bill conveying channel 127 is opened, and an inserted bill A inserted in the direction of arrow B is passed through, the second plate 152 is pulled up over a predetermined distance with the aid of a rack-and-pinion mechanism 151 that comprises a pinion 157*a*, which is composed of the spur gear of a shutter motor 157, and a rack 152*b*, which is formed in the second plate 152 and which engages the pinion 157*a*, whereby the multiple plates 153 that form the shutter 154 at the lower end of the second plate 52 retract from the holes 156*a* formed in the lower chute 156, and open the bill conveying channel 127 formed between the lower and upper chutes 155 and 156.

When, on the other hand, the bill conveying channel 127 is closed following the passage of the inserted bill A, the second plate 152 is pulled down over a predetermined distance through the agency of the rack-and-pinion mechanism 151 by means of the driving force of the shutter motor 157, as shown in FIG. 39, whereby the multiple plates 153 that form the shutter 154 at the lower end of the second plate 152 are installed into the holes 156*a* formed in the lower chute 156, and close the bill conveying channel 127 formed between the lower and upper chutes 155 and 156.

If the bill conveying channel 127 is closed by the shutter 154 in a manner such as that shown in FIG. 39 above, it is possible to prevent the forcible extraction of the inserted bill A in the direction of arrow C because the entire cross-directional region of the bill conveying channel 127 is closed by the multiple plates 153, even when an attempt is made to forcibly pull out the inserted bill A. With the aforementioned shutter means 132, the driving force of the shutter motor 157 is transmitted to the second plate 152 via the rack-and-pinion mechanism 151 in a manner such as that shown in FIG. 38, thus pulling down the second plate 152 over a predetermined distance and closing the bill conveying channel 127 formed between the upper and lower chutes 155 and 156. However, because the second plate 152 is connected with the motor 157 via a rack-and-pinion mechanism 151 that develops a low frictional force between the engaged gears and has a low reduction ratio, as viewed from the side of the motor 157, the resulting disadvantage is that the motor 157 rotates at a proportional pace when the second plate 152 is forcibly pulled upward from the position in which the bill conveying channel 127 is closed, thereby tending to lift the second plate 152 and to open the bill conveying channel 127.

SUMMARY OF THE INVENTION

In view of the above, an object of this invention is to provide a bill processing device in which tampering performed by using a bill introduced into the stacking unit can be reliably prevented.

Another object of this invention is to provide a bill processing device in which operability is improved and bill removal operations are facilitated when bill jamming occurs.

Yet another object of this invention is to provide, in light of the above situation, a bill processing device in which the shutter that opens and closes the bill conveying channel is not moved by external forces.

To attain the stated objectives, this invention comprises: a bill processing device that intakes into the device a bill inserted into a bill insertion slot, performs identification in an identification unit, temporarily holds in a temporary holding unit the bill identified as authentic by the identification unit, returns the bills held in the temporary holding unit to the bill insertion slot in accordance with a bill return command, and introduces the bills held in the temporary holding unit into a stacking unit and stacks them there in accordance with a bill deposition command, wherein the device additionally comprises an abnormally returned bill detection means that identifies returned bills as abnormally returned bills if the number of returned bills is two or more, and an abnormal-state processing means that performs predetermined abnormal-state processing if the abnormally returned bill detection means has identified the returned bills as abnormally returned bills.

This invention is also a bill processing device that intakes into the device a bill inserted into a bill insertion slot, performs identification in an identification unit, temporarily holds in a temporary holding unit the bill identified as authentic by the identification unit, returns the bills held in the temporary holding unit to the bill insertion slot in accordance with a bill return command, and introduces the bills held in the temporary holding unit into a stacking unit and stacking them there in accordance with a bill deposition command, wherein the device additionally comprises a first detection means that detects the light transmitted amount of the returned bills during the return of the bills, and identifies the returned bills as abnormally returned bills if the light transmitted amount is found to be smaller than the light transmitted amount corresponding to that of a single bill; a second detection means that detects the presence or absence of an interval between the returned bills during the return of the bills, and identifies the returned bills as abnormally returned bills if it is established that there is an interval; a third detection means that determines the length of the returned bills during the return of the bills, and identifies the returned bills as abnormally returned bills if it is established that the returned bill length thus determined exceeds the length corresponding to that of a single bill; a forcible intake means that introduces the returned bills into the stacking unit and forcibly stacks them there if the first detection means or the second detection means has identified the returned bills as abnormally returned bills; and a abnormal-state signalling means that stops the operation involving the return of the returned bills and indicates the presence of an abnormal state if the third detection means has identified the returned bills as abnormally returned bills.

This invention involves noting that the number of returned bills is at least two if tampering is effected using bills introduced into the stacking unit and the bills are returned as a result of this tampering, identifying the returned bills as abnormally returned bills by means of an abnormally returned bill detection means if the number of the returned bills is two or greater during bill return, and performing predetermined abnormal-state processing if the abnormally returned bill detection means has identified the returned bills as abnormally returned bills.

As used herein, the abnormally returned bill detection means detects the light transmitted amount of the returned bills and identifies the returned bills as abnormally returned bills if the light transmitted amount is smaller than the light transmitted amount corresponding to that of a single bill. In addition, the abnormally returned bill detection means detects whether or not there is an interval between the returned bills, and identifies the returned bills as abnormally returned bills if the presence of an interval is detected.

Furthermore, the abnormally returned bill detection means determines the length of the returned bills, and the returned bills are identified as abnormally returned bills if the returned bill length thus determined exceeds the length corresponding to that of a single bill.

Moreover, the abnormal-state processing means additionally comprises a forcible intake means that introduces the returned bills into the stacking unit and performs forced stacking.

In addition, the abnormal-state processing means additionally comprises a abnormal-state signalling means that stops the return of the returned bills and indicates the presence of an abnormal state.

Furthermore, this invention involves installing (1) a first detection means that detects the light transmitted amount of returned bills and identifies the returned bills as abnormally returned bills if the light transmitted amount is found to be smaller than the light transmitted amount corresponding to that of a single bill, (2) a second detection means that determines whether or not there is an interval between the returned bills during the return of the bills, and identifies the returned bills as abnormally returned bills if it is established that there is an interval, and (3) a third detection means that detects the length of returned bills during the return of the bills and identifies the returned bills as abnormally returned bills if the returned bill length thus determined exceeds the length corresponding to that of a single bill, wherein the forcible intake means introduces the returned bills into the stacking unit and forcibly stacks them there if the first detection means or the second detection means has identified the returned bills as abnormally returned bills, and a abnormal-state signalling means stops the operation involving the return of the returned bills and indicates the presence of an abnormal state if the third detection means has identified the returned bills as abnormally returned bills.

To attain the stated objective, this invention comprises: a bill processing device that conveys a bill inserted into a bill insertion slot into the device along a bill conveying channel, and, if it is determined that the bill inside the device is authentic, accepts and stores the bill in a bill receptacle inside the device, wherein the device additionally comprises a bill jamming direction memory means that stores in memory the jamming direction of a bill if the bill has jammed in the bill conveying channel, and a bill reverse-direction conveyance control means that conveys the bill in the direction opposite to the bill jamming direction stored in the bill jamming direction memory means when a bill that has become jammed in the bill conveying channel is to be removed.

This invention is also a bill processing device that conveys a bill inserted into a bill insertion slot into the device along a bill conveying channel, and, if it is determined that the bill inside the device is authentic, accepts and stores the bill in a bill receptacle inside the device, wherein the device additionally comprises an opening means that partially opens the bill conveying channel, and a bill conveyance control means that conveys the bills in the bill conveying channel in a predetermined direction for a predetermined time when the bill conveying channel has been partially opened by the opening means.

This invention involves storing in memory the jamming direction of a bill in the bill jamming direction memory means if the bill has jammed in the bill conveying channel, and, when removing the jammed bill from the bill conveying channel, conveying the bill with the aid of the bill reverse-direction conveyance control means in the direction opposite to the bill jamming direction stored in the bill jamming direction memory means.

As used herein, the bill jamming direction memory means stores as the jamming direction of the bill the direction in which the bill was conveyed immediately before the bill jamming occurred.

In addition, the bill reverse-direction conveyance control means comprises a timer means that measures a predetermined length of time and conveys the bill in the direction opposite to the jamming direction of the bill during the length of time measured by the timer means.

Furthermore, the bill reverse-direction conveyance control means comprises a bill detection means that detects the presence or absence of a bill in the bill conveying channel, and conveys the bill in the direction opposite to the jamming direction of the bill under conditions in which the presence of the bill in the bill conveying channel is detected by the bill detection means.

Moreover, bills are conveyed along the bill conveying channel in a predetermined direction for a predetermined time by a bill conveyance control means when the bill conveying channel has been partially opened by the opening means that partially opens the bill conveying channel.

As used herein, the bill conveyance control means comprises a bill jamming direction detection means that stores in memory the direction of the bill jamming that has occurred in the bill conveying channel, and a bill reverse-direction conveyance means that conveys, when the bill conveying channel has been partially opened by the opening means, the bill in the direction opposite to the bill jamming direction stored in the bill jamming direction memory means.

In addition, the bill conveyance control means comprises a bill jamming direction memory means that stores in memory the direction of the bill jamming that has occurred in the bill conveying channel, a timer means that measures a predetermined length of time, a bill detection means that detects the presence or absence of a bill in the bill conveying channel, and a bill reverse-direction conveyance means that conveys the bill in the direction opposite to the bill jamming direction stored in the bill jamming direction memory means, during the length of time measured by the timer means and under conditions in which the presence of the bill in the bill conveying channel is detected by the bill detection means when the bill conveying channel has been partially opened by the opening means.

To solve the problems noted above, this invention involves providing a bill processing device in which a bill conveying channel connected to a bill insertion slot is opened and closed by a shutter, and the shutter is driven by a motor via a gear transmission means, wherein the gear transmission means comprises a worm gear that is secured to the drive shaft of the motor, and a worm wheel that engages the worm gear.

With the aforementioned bill processing device, the shutter that opens and closes the bill conveying channel is driven by a motor via a gear transmission means comprising a worm gear that is secured to the drive shaft of the motor, and a worm wheel that engages the worm gear, creating an interposed mechanical reduction gear that develops considerable frictional force between the gears and has a high reduction ratio, as viewed from the motor side, so the motor does not rotate at a proportional pace, and therefore the shutter does not move upward, even when an attempt is made to push the shutter upward from the closed state of the bill conveying channel by an outside force.

DESCRIPTION OF THE PREFERRED EMBODIMENTS

A embodiment of the bill processing device according to this invention will be described in detail below with reference to the accompanying drawings.

Figure 1:
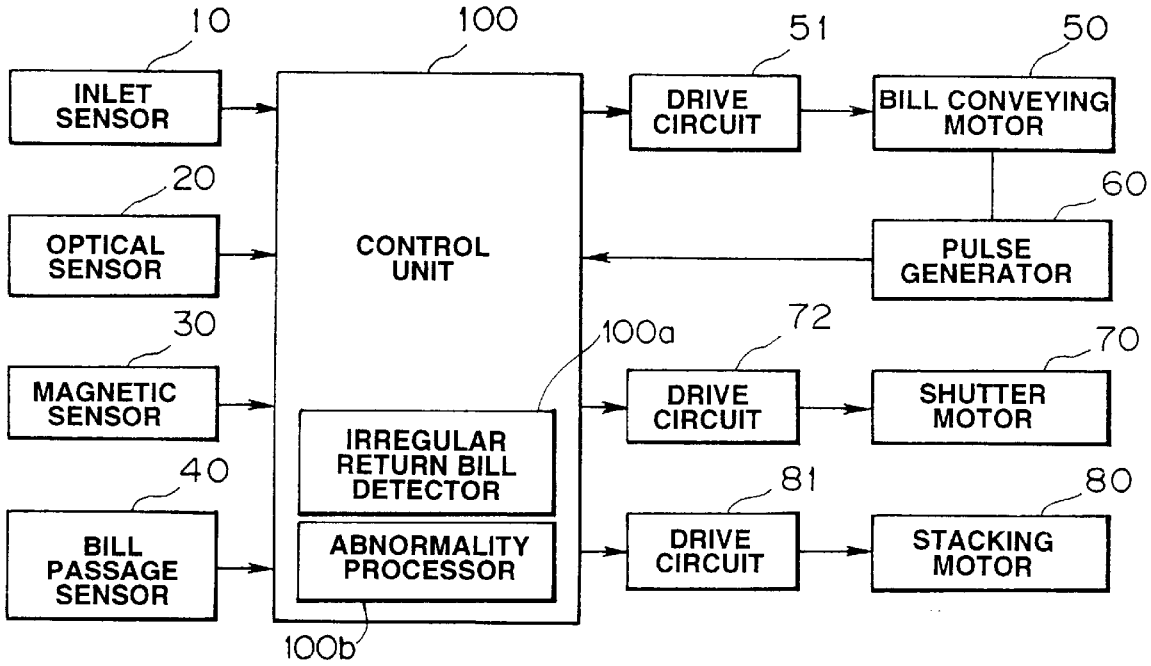
FIG. 1 is a block diagram illustrating the overall structure of the control system for a embodiment of the bill processing device according to this invention.
Figure 2:
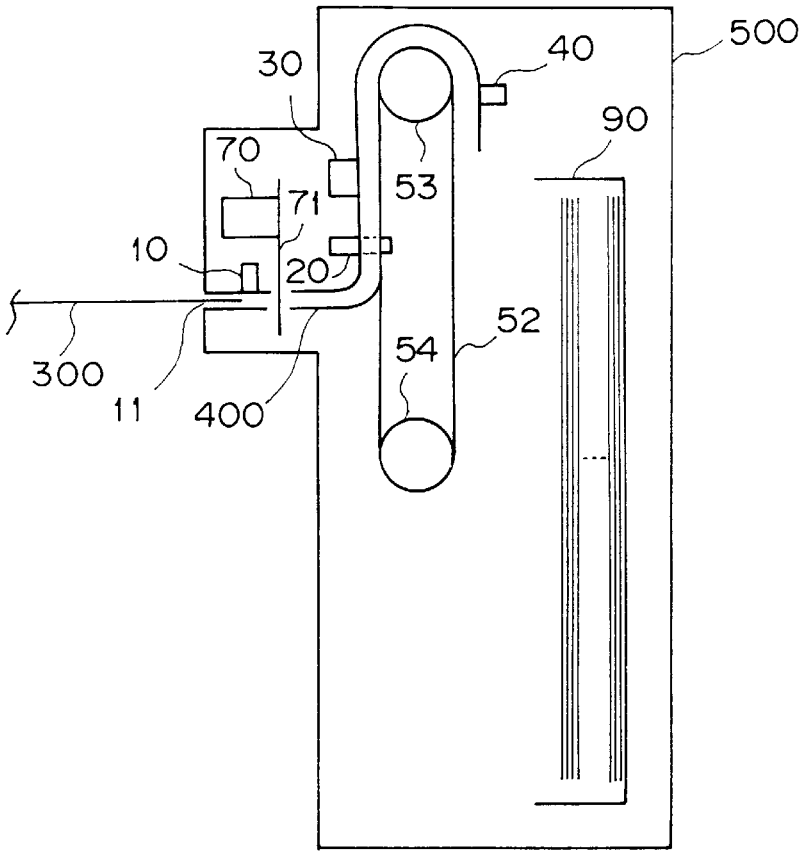
FIG. 2 is a side view illustrating a schematic structure of a embodiment of the bill processing device according to this invention.

FIG. 1 is a block diagram illustrating the overall structure of the control system for the bill processing device according to this invention, and FIG. 2 is a side view illustrating a schematic structure of the bill processing device 500 according to this invention.

In FIGS. 1 and 2, an inlet sensor 10 that detects a bill 300 inserted into a bill insertion slot 11 is installed in the bill processing device 500 near the bill insertion slot 11.

As will be described in detail below, the inlet sensor 10 comprises two inlet sensors P1R and P1L installed at both ends of the bill insertion slot 11, the detection output from the inlet sensor 10 is input to a control unit 100, the control unit 100 drives a bill conveying motor 50 via a drive circuit 51 on the basis of the detection output of the inlet sensor 10, the operation of a conveyance mechanism (not shown in its entirety) is thus initiated, and the bill 300 inserted into the bill insertion slot 11 is conveyed along a bill conveying channel 400.

As used herein, a bill conveyor belt 52 suspended between a pulley 53 and a pulley 54 comprises a portion of the aforementioned conveyance mechanism, and the bill 300 that has reached the mounting position of the bill conveyor belt 52 is conveyed by the bill conveyor belt 52 along the bill conveying channel 400.

An inlet shutter 71 is installed in the bill conveying channel 400. The inlet shutter 71 opens and closes the bill conveying channel 400 by being moved up and down with the aid of a shutter motor 70; the shutter motor 70 is driven by the control unit 100 via the a drive circuit 72.

In addition, the bill conveying channel 400 is equipped with an optical sensor 20 and a magnetic sensor 30 for bill identification.

The optical sensor 20 and magnetic sensor 30 read the necessary data from the bill 300 that is conveyed along the bill conveying channel 400. The output from the optical sensor 20 and magnetic sensor 30 is input to the control unit 100, and the control unit 100 establishes the authenticity of the bill 300 on the basis of the output from the optical sensor 20 and magnetic sensor 30.

In addition, the bill conveying channel 400 is equipped with a bill passage sensor (P2) 40 for detecting the passage of the bill 300 that has travelled past the mounting positions of the optical sensor 20 and the magnetic sensor 30. The detection output from the bill passage sensor (P2) 40 is applied to the control unit 100.

A stacker 90 for accumulating the bills 300 that have been conveyed through the bill conveying channel 400 is installed in the terminal-point portion of the bill conveying channel 400.

The bills 300 that have been conveyed through the bill conveying channel 400 are stacked in the stacker 90 using a stacking mechanism (not shown) driven by a stacking motor 80.

Figure 3:
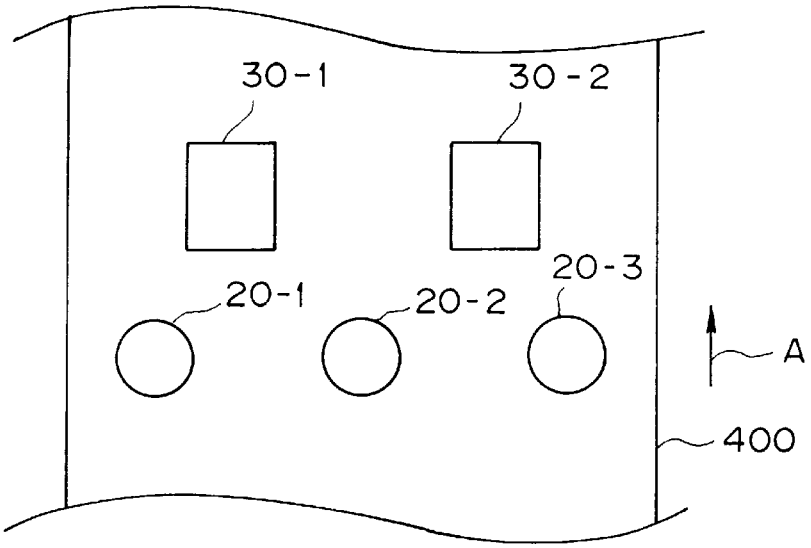
FIG. 3 is a drawing illustrating an example of the arrangement for the optical and magnetic sensors in this embodiment.

The stacking motor 80 is driven via a drive circuit 81 by the stacking commands from the control unit 100. In addition, the bill conveying motor 50 is equipped with a pulse generator 60 that generates pulses in synchronism with the rotation of the bill conveying motor 50, the pulses generated by the pulse generator 60 are applied to the control unit 100, and the control unit 100 determines the position of the bill in the bill conveying channel 400 by counting the pulses. In addition, the optical sensor 20 and magnetic sensor 30 used in this embodiment comprises three optical sensors (PXR) 20-1, (PXC) 20-2, and (PXL) 20-3, for detecting the amount of light transmitted through a bill and two magnetic sensors 30-1 and 30-2 for detecting magnetic property of a bill, which, as shown in FIG. 3, are arranged in a row in a direction perpendicular to the direction A in which the bills are conveyed in the bill conveying channel 400. As will be described in detail below, the authenticity of the bills conveyed along the bill conveying channel 400 is established based on the detection output of the three optical sensors (PXR) 20-1, (PXC) 20-2, and (PXL) 20-3 as well as on that of the two magnetic sensors 30-1 and 30-2.

In addition, the control unit 100 is equipped with an abnormally returned bill detection unit 100*a* and an abnormality processor 10*b*, and the abnormally returned bill detection unit 100*a* identifies the returned bills as abnormally returned bills if the number of the returned bills is two or more during bill return.

As used herein, abnormally returned bills are detected by the abnormally returned bill detection unit 100*a* in the following manner.

(1) The three optical sensors (PXR) 20-1, (PXC) 20-2, and (PXL) 20-3 detect the light transmitted amount of returned bills and identify the returned bills as abnormally returned bills if the light transmitted amount exceeds the light transmitted amount corresponding to that of a single bill.

(2) Based on the detection output of the three optical sensors (PXR) 20-1, (PXC) 20-2, and (PXL) 20-3, the presence or absence of an interval between the returned bills is detected, and the returned bills are identified as abnormally returned bills if the presence of an interval has been detected.

(3) The length of the returned bills is determined using pulses generated by the pulse generator 60, and the returned bills are identified as abnormally returned bills if the returned bill length thus determined exceeds the length corresponding to that of a single bill.

The abnormality processor 100*b* performs bill intake processing by introducing returned bills into the stacking unit and forcibly stacking them in the stacker 90 if the returned bills have been identified as abnormally returned bills in accordance with (1) or (2), and stops the bill return operation and indicates the presence of an abnormal state if the returned bills have been identified as abnormally returned bills in accordance with (3).

The reason that the device is structured such the operation involving the return of returned bills is stopped and the presence of an abnormal state is indicated without subjecting the bills to intake processing if the returned bills have been identified as abnormally returned bills in accordance with (3) is that even in the case of normal bill return, detection in accordance with (3) sometimes occurs under these conditions if, for example, the customer pushes a bill into the bill insertion slot 11, and the bill becomes jammed.

The operation of the bill processing device of this embodiment will first be outlined with reference to FIG. 2 and FIGS. 4 through 8.

As shown in FIG. 2, when a bill 300 is inserted into the bill insertion slot 11, the bill 300 is first detected by the inlet sensor 10.

Figure 4:
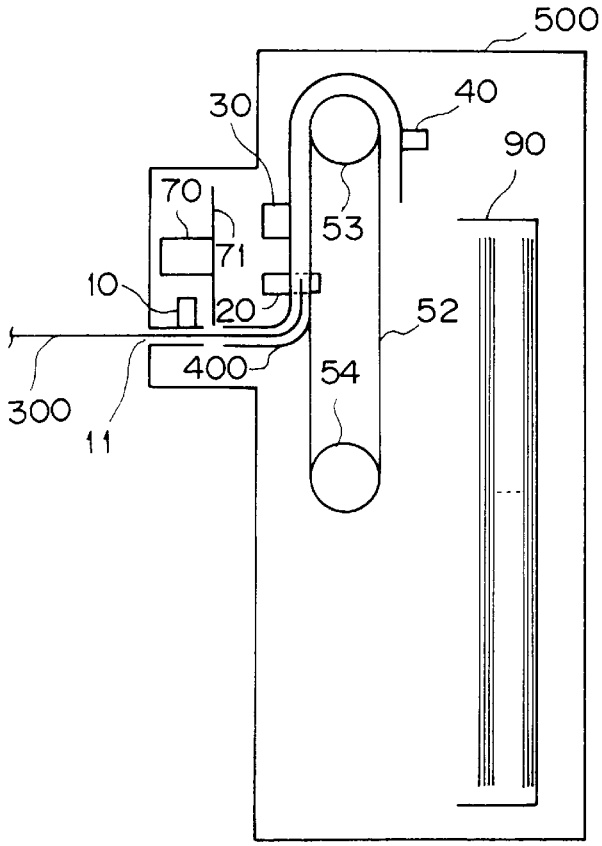
FIGS. 4 through 8 are drawings illustrating the general operations of this embodiment.

When the insertion of the bill 300 is detected by the inlet sensor 10, the shutter motor 70 is driven by the detection output from the inlet sensor 10, the shutter 71 is moved upward, as shown in FIG. 4, and the bill conveying channel 400 is open.

In addition, the bill conveying motor 50 is driven by the detection output from the inlet sensor 10, and the bill 300 inserted into the bill insertion slot 11 is introduced into the device by a conveyance mechanism (not shown) and conveyed upward by the bill conveyor belt 52. An operation involving the identification of the bill 300 by the optical sensor 20 is started when the leading edge of the bill 300 reaches the mounting position of the optical sensor 20.

The structure adopted in this embodiment is such that the intermittent determination of a bill 300 is accomplished based on the detection output of the optical sensor 20, and overall determination is subsequently accomplished based on the detection output of the optical sensor 20 and the detection output of the magnetic sensor 30.

Specifically, this embodiment is configured in such a way that a bill 300 is divided into multiple points in the longitudinal direction of the bill, the detection output of the optical sensor 20 is sampled at these multiple points, the sampled values are successively compared with the predetermined criteria (identification data) corresponding to the aforementioned multiple points, the bill is identified as counterfeit the moment a sampled value falls outside the permissible identification data range, the bill conveying motor 50 is reversed, and the bill identified as counterfeit is thereby returned to the bill insertion slot 11, completing the so-called intermittent determination.

In addition, the detection data of the optical sensor 20 and the detection data of the magnetic sensor 30 are stored, and these stored data serve as a basis for performing comprehensive determination with respect to the bills identified as authentic by the optical sensor 20 in the course of intermittent determination.

The above description concerned performing intermittent determination on the basis of the output from the optical sensor 20, although it is also possible to adopt a structure in which intermittent determination is accomplished while taking into account the output from the magnetic sensor 30 as well.

Figure 5:
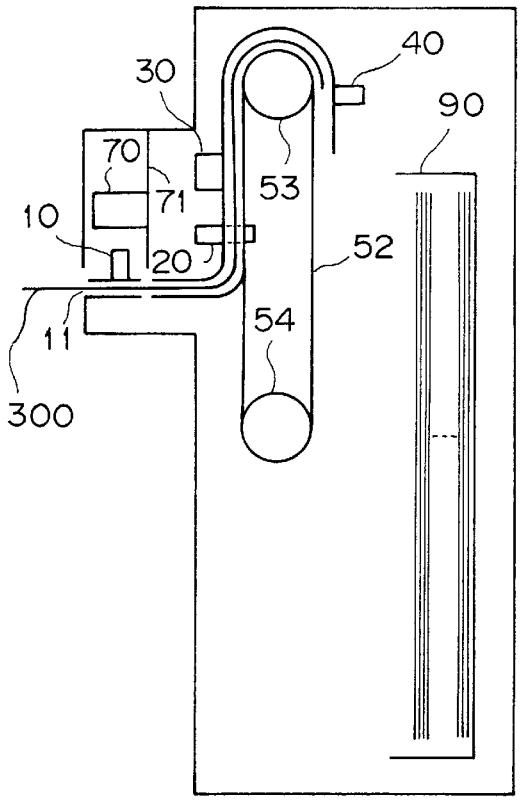
Figure 6:
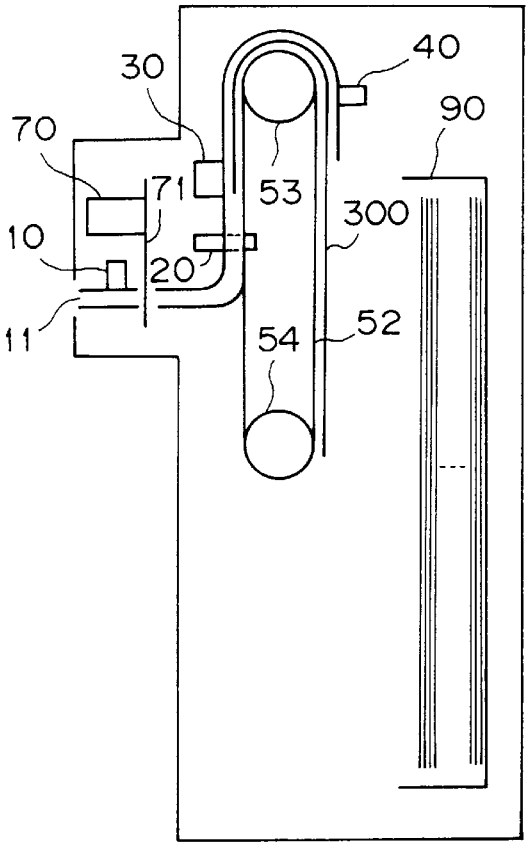

When the leading edge of the bill 300 conveyed by the conveyor belt 52 along the bill conveying channel 400 reaches the mounting position of the bill passage sensor 40 in a manner such as that shown in FIG. 5, the bill passage sensor 40 is switched on, and when the bill 300 advances further and the back edge of the bill 300 reaches the mounting position of the magnetic sensor 30 in a manner such as that shown in FIG. 6, comprehensive determination is performed based on the detection data supplied by the aforementioned magnetic sensor 30, so if the bill 300 is identified as authentic under these conditions, the shutter motor 70 is operated, the shutter 71 is moved downward, and the bill conveying channel 400 is closed.

Figure 7:
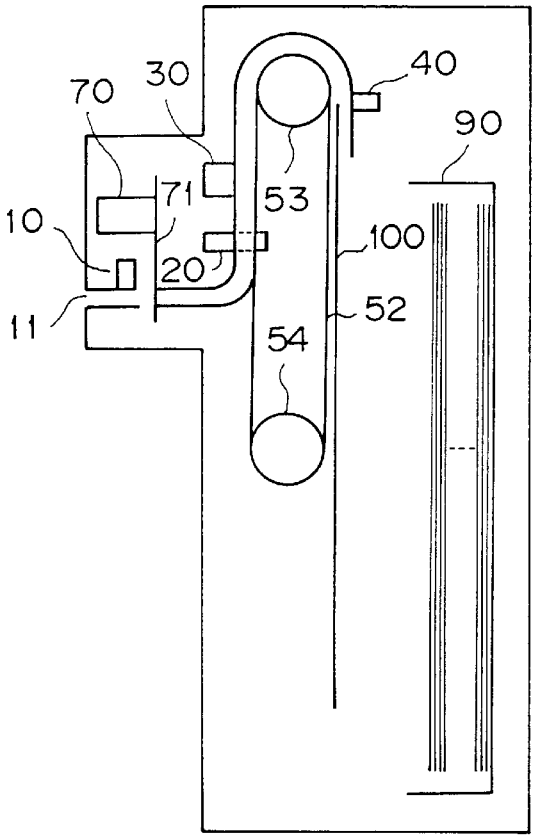

The bill 300 then advances further along the bill conveying channel 400, and when the back edge of the bill 300 reaches the mounting position of the bill passage sensor 40 in a manner such as that shown in FIG. 7, the bill passage sensor 40 is switched off, and the bill 300 reaches the state of temporary holding (the escrow state).

Figure 8:
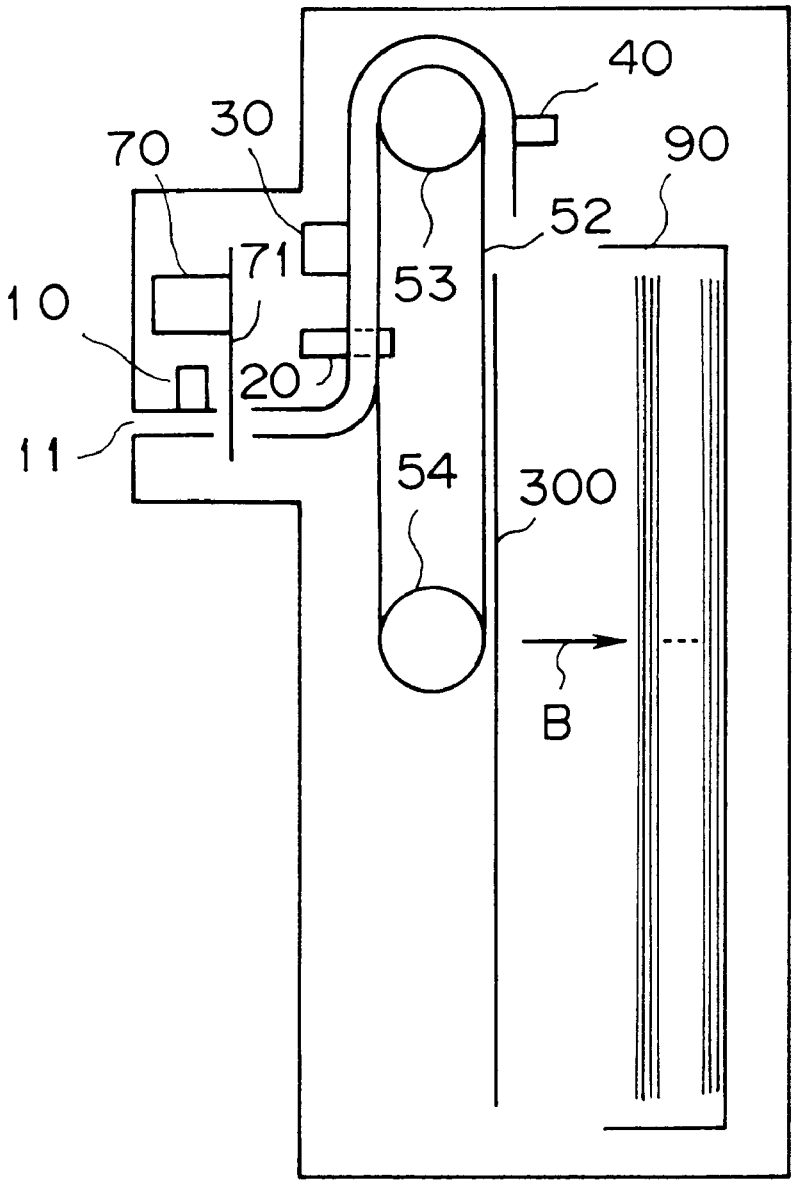

When a stacking command is received from the control unit 100 in this state, the bill 300 is advanced to the position shown in FIG. 8, driven by the bill conveyor belt 52, moved in the direction shown by arrow B by a stacking mechanism (not shown) while remaining in this position, and stacked in the stacker 90.

Figure 9:
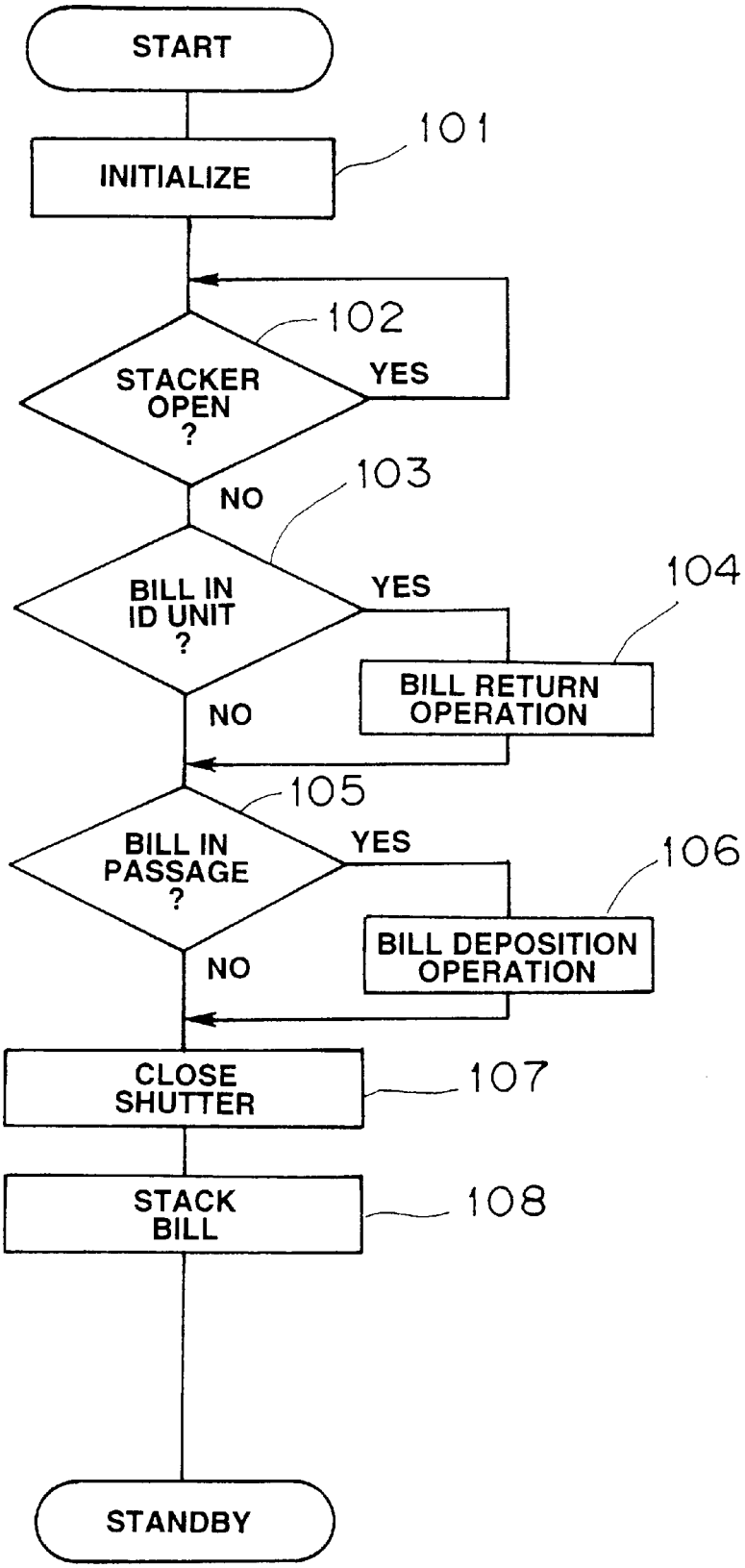
FIG. 9 is a flow chart illustrating the initial-period operation of the bill processing device of this embodiment during the initiation at the start of power supply.

FIG. 9 illustrates, in the form of a flow chart, the initial-period operation of the bill processing device of this embodiment during the initiation of power supply or the like.

Initial-period operation during the initiation of power supply or the like involves the initialization of the control unit 100, that is, involves performing storage device (RAM; not shown) resetting, port initialization, and the like (step 101).

It is then checked whether the door (not shown) of the stacker 90 is opened (step 102).

If, under these conditions, the door of the stacker 90 is open, the door is closed, it is then checked whether there is a bill in the identification unit, that is, at the mounting positions of the optical sensor 20 and the magnetic sensor 30 (step 103), the presence of a bill results in an operation involving the return of a bill (step 104), and in the absence of a bill, a check to determine whether there is a bill in the bill channel, that is, in the bill conveying channel 400 (step 105) is performed.

Under these conditions, if the bill conveying channel 400 contains a bill, a bill deposition operation in which the bill (step 106) is accepted is performed, and if there is no bill, the shutter motor 70 is operated, the shutter is closed (step 107), a stacking operation (step 108) follows in which the stacking motor 80 is operated and the bills in the bill conveying channel 400 are stacked in the stacker 90, and standby mode is assumed.

Figure 10:
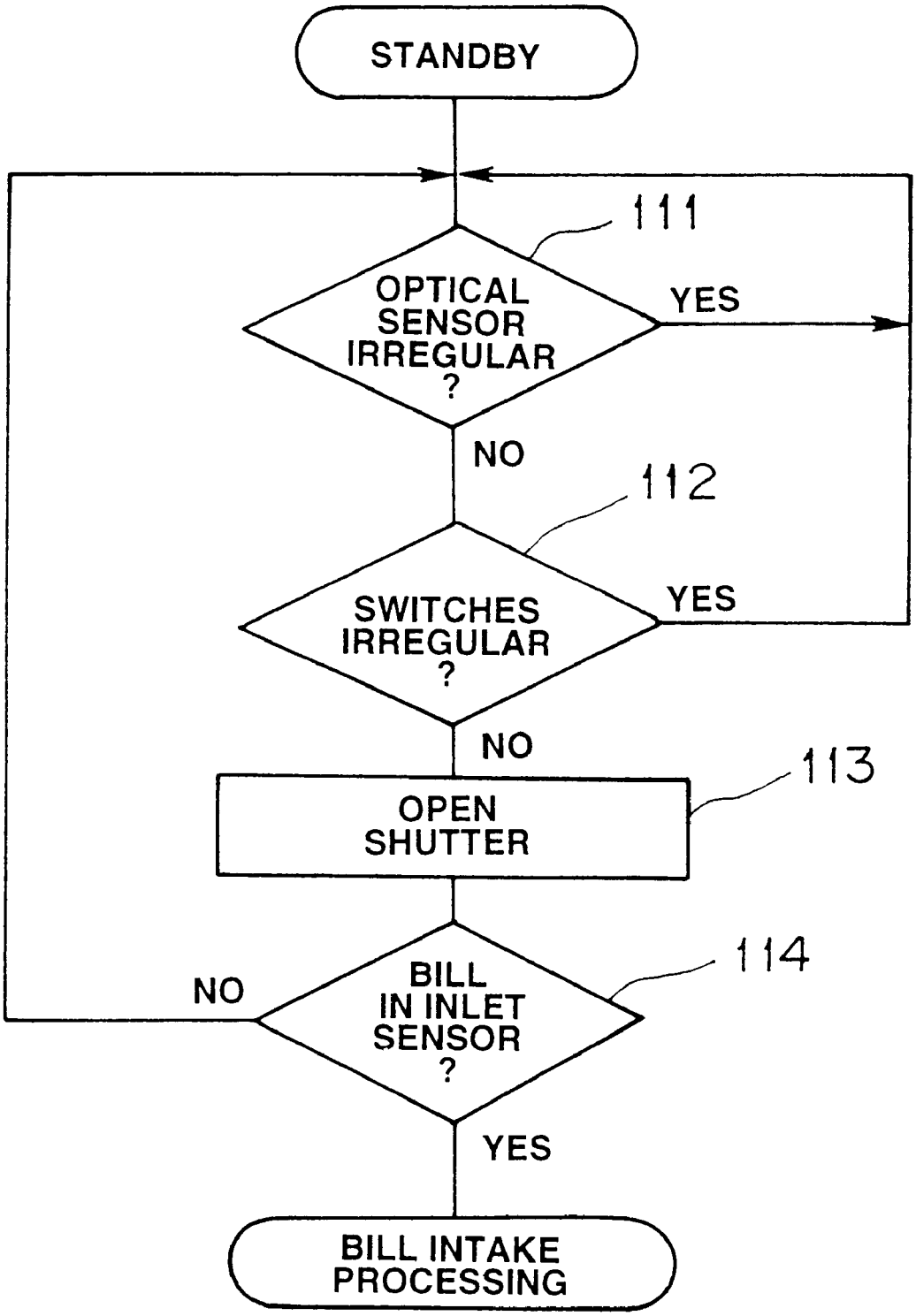
FIG. 10 is a flow chart illustrating how the bill processing device of this embodiment operates in the standby mode.

FIG. 10 illustrates, in the form of a flow chart, the operation in the standby mode.

This operation involves first checking whether any abnormalities exist in the optical sensor 20 (step 111), checking whether any abnormalities exist in the switches (step 112) if no abnormalities are found in the optical sensor 20, running the shutter motor 70 and opening the shutter (step 113) if no abnormalities are found, checking whether there is a bill at the inlet sensor 10 (step 114), proceeding with a bill intake processing when a bill is present, and returning to the standby mode when no bill is present.

Figure 11:
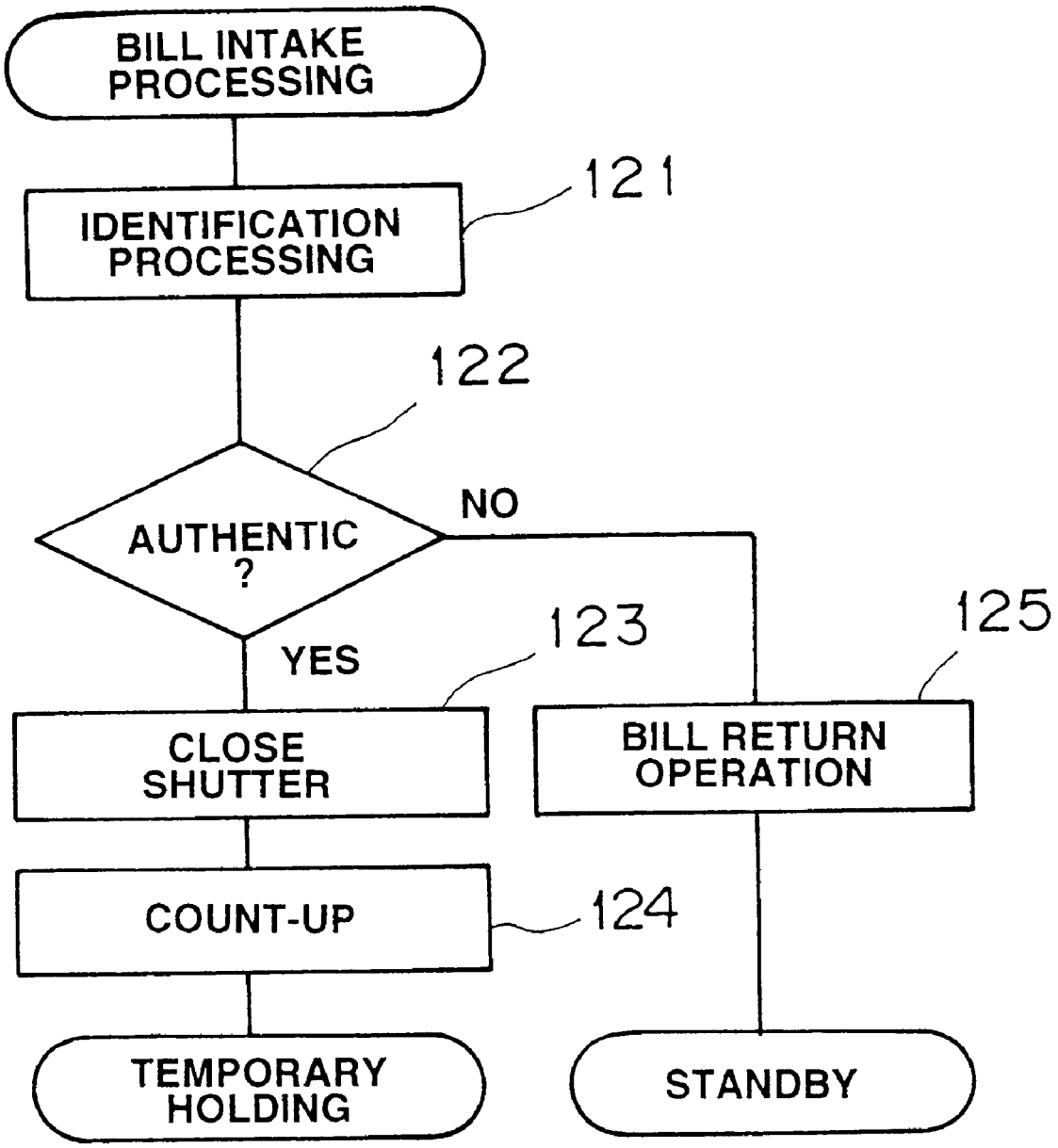
FIG. 11 is a flow chart illustrating how the bill processing device of this embodiment operates when a bill has been inserted into the bill insertion slot.

FIG. 11 illustrates, in the form of a flow chart, how the bill intake processing is performed if a bill has been inserted into the bill insertion slot.

The bill intake processing involves first identifying the bill on the basis of the detection output from the optical sensor 20 and the magnetic sensor 30 (step 121), setting the shutter motor 70 in motion and closing the shutter (step 123) if the identification processing of the bill has demonstrated that the inserted bill is authentic (step 122), and counting up the bill that has been identified as authentic (step 124) and then temporarily holding (escrowing) the bill identified as authentic.

In addition, if it has been determined during step 122 that the bill is not authentic, that is, that it is counterfeit, the bill conveying motor 50 reverses its rotation, and an operation is performed in which the bill identified as counterfeit is returned to the bill insertion slot 11 (step 125), and standby mode is assumed.

Figure 12:
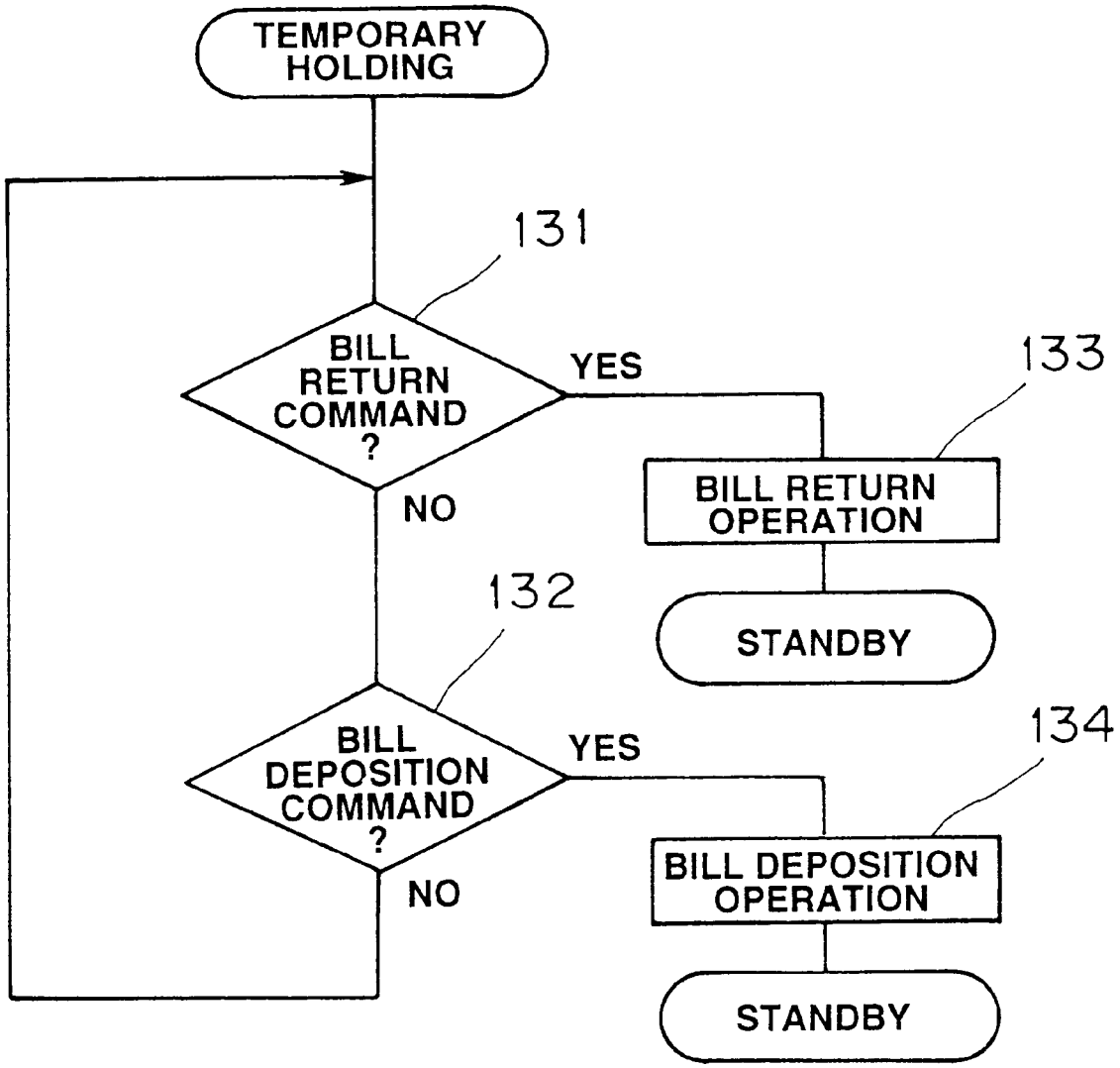
FIG. 12 is a flow chart illustrating how the bill processing device of this embodiment operates during temporary holding (escrow)

FIG. 12 illustrates, in the form of a flow chart, the operation performed during temporary holding (escrowing).

First, during the temporary holding (escrowing) it is determined whether a bill return command has been sent (step 131), a bill return operation is performed (step 133) if a bill return command has been made, and standby mode is assumed.

In addition, the absence of a bill return command during step 131 is followed by checking whether there is a bill deposition command, that is, whether a stacking command has been made (step 132), and if a bill deposition command has been made, a bill deposition operation is performed (step 134), and standby mode is assumed.

In addition, the operation returns to step 131 if no bill deposition commands are detected during step 132.

This embodiment is configured in such a way that if two or more bills are returned during the bill return operation described with reference to the step 104 in FIG. 9 above, during the bill return operation described with reference to the step 125 in FIG. 11, and during the bill return operation described with reference to the step 133 in FIG. 12, this fact is detected, and the following operations are performed if it is detected that two bills have been returned.

(1) The returned bills are introduced into the stacking unit and are forcibly stacked in the stacker 90.

(2) The operation involving the return of returned bills is stopped, and the presence of an abnormal state is indicated.

The bill return operation, that is, the bill return processing involved in this embodiment, will now be described in detail.

Figure 13:
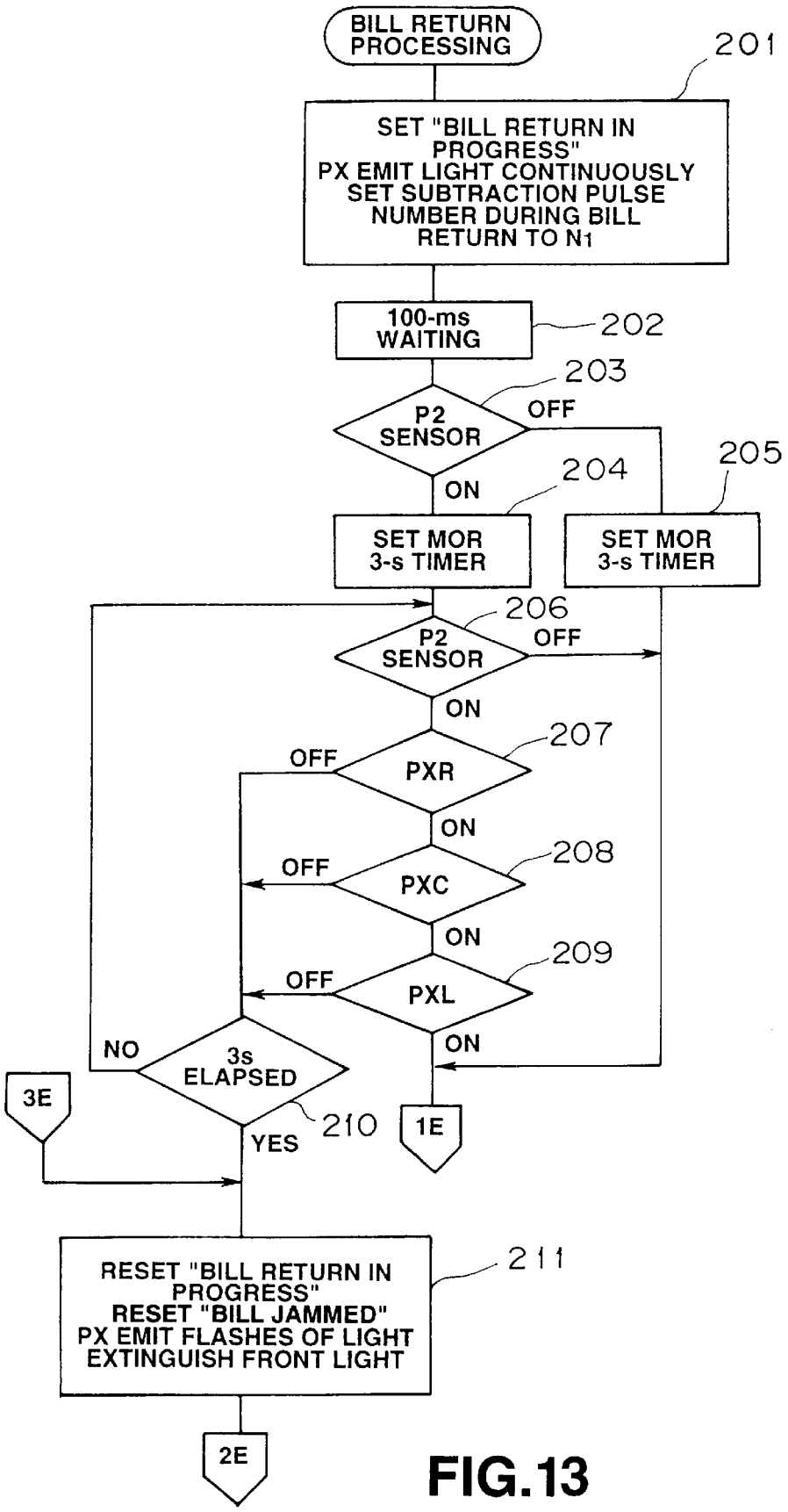
FIGS. 13 through 15 are flow charts illustrating the details of how bill return processing is performed in this embodiment during the initiation of power supply.
Figure 14:
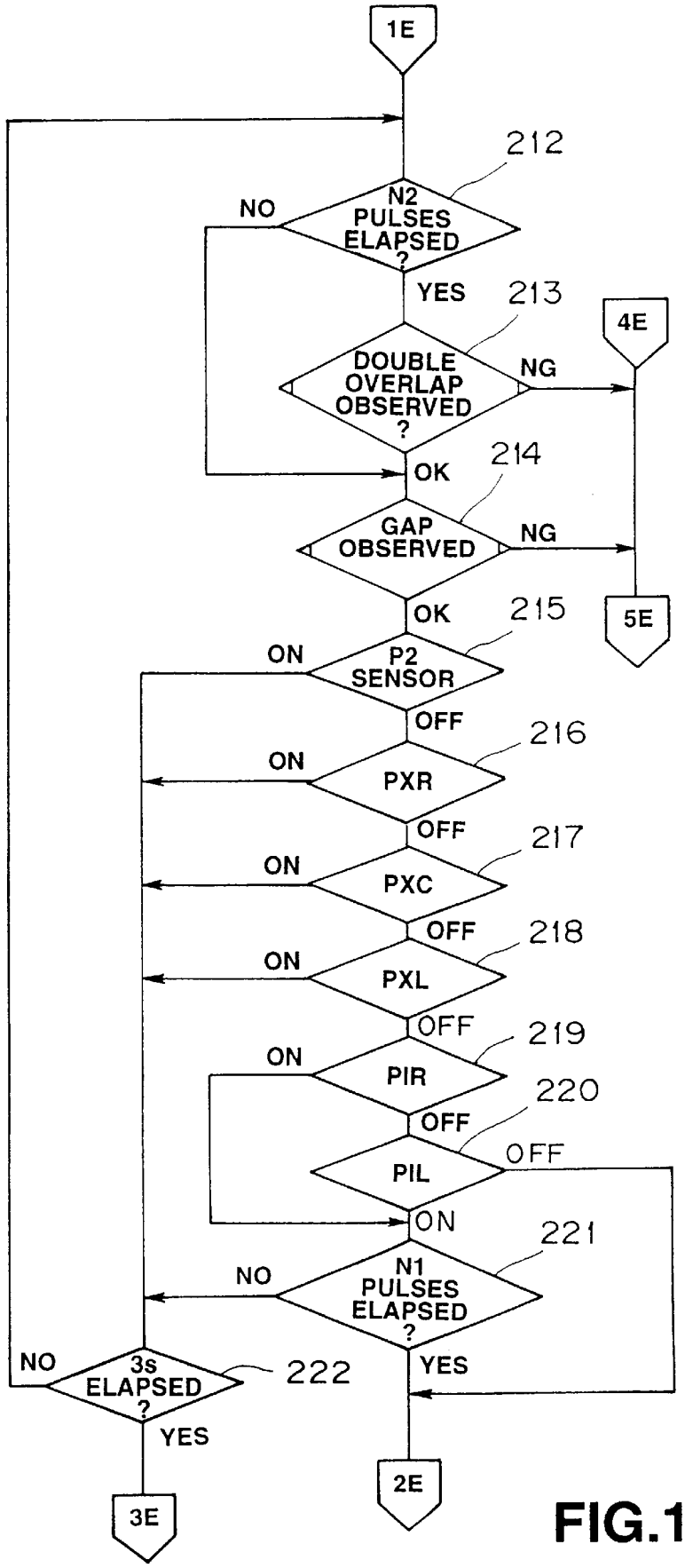
Figure 15:
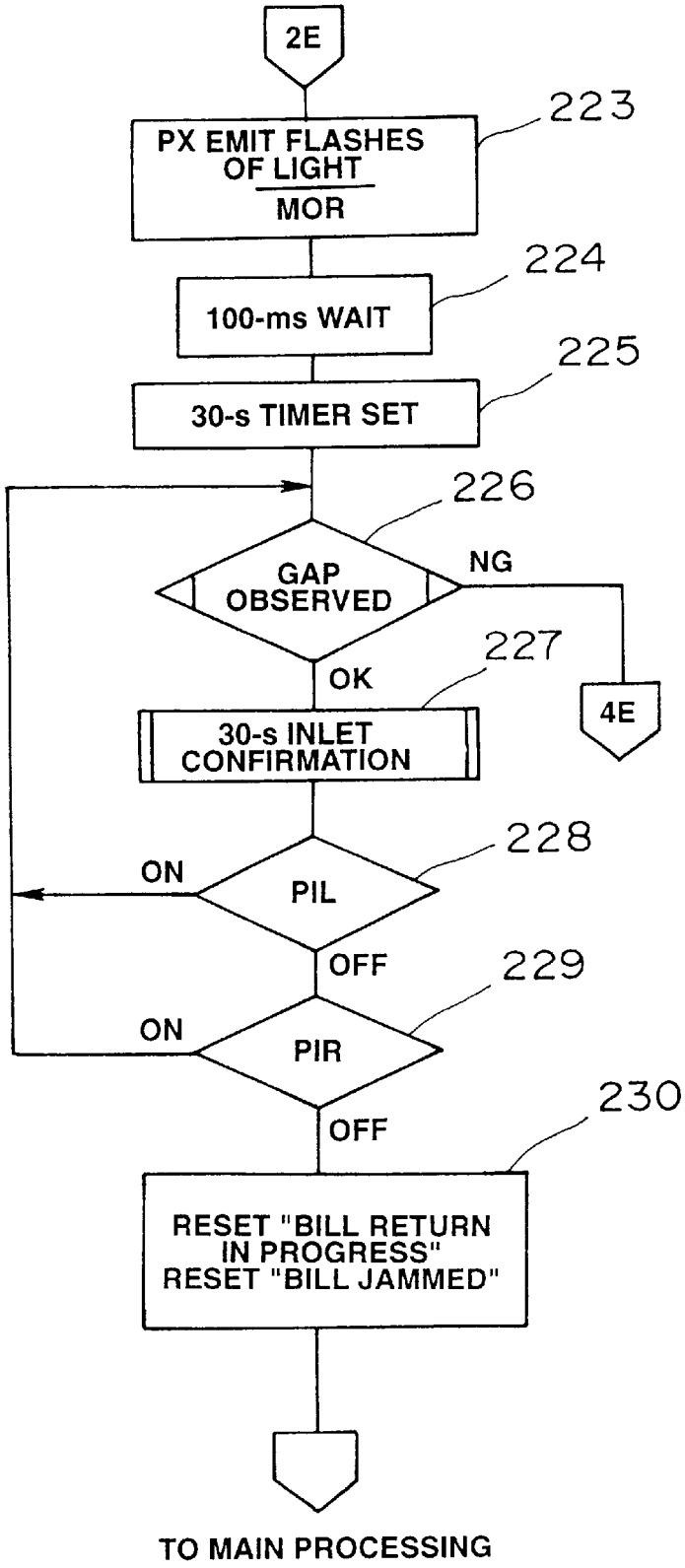

FIGS. 13 through 15 illustrate the details of a bill return processing performed during the initiation of power supply, that is, the details of the bill return operation involved in step 104 shown in FIG. 9.

In FIG. 13, a flag indicating that a bill return operation is in progress is first set, the optical sensor (PX) 20, that is, the optical sensors (PXR) 20-1, (PXC) 20-2, and (PXL) 20-3, are controlled so as to be continuously lit, and the number of subtraction pulses to be used during the bill return operation is set (step 201) to N1 (for example, to 510).

The number of subtraction pulses set in this manner is counted down in the control unit 100 by the pulses generated in a pulse generation circuit 60 driven by the bill conveying motor 50.

A waiting period of 100 ms follows (step 202), and it is checked whether the P2 sensor, that is, the bill passage sensor 40, is on or off (step 203).

When the P2 sensor is on under these conditions, the bill conveying motor (MOR) 50 is operated, and a 3-second timer will be set (step 204).

It is then checked whether the P2 sensor is on or off (step 206); when the P2 sensor is on, it is subsequently checked whether PXR, that is, the optical sensor 20-1, is on or off (step 207); when the PXR is on, it is subsequently checked whether PXC, that is, the optical sensor 20-2, is on or off (step 208); when the PXC is on, it is subsequently checked whether PXL, that is, the optical sensor 20-3, is on or off (step 209); and when PXL is on, the operation proceeds to the step 212 in FIG. 14.

If it is established during step 203 that the P2 sensor is off, the bill conveying motor (MOR) 50 is operated, the 3-second timer is set (step 205), and the operation proceeds to the step 212 in FIG. 14.

In addition, the operation proceeds to step 210 if it has been established during step 207 that PXR is off, if it has been established during step 208 that PXC is off, and if it has been established during step 209 that PXL is off; it is checked whether 3 seconds have elapsed, that is, whether the 3-second timer set during step 204 has run out of time; if the 3 seconds have not elapsed, the operation returns to step 206; and if the 3 seconds have elapsed, designation of a bill jam is made and the flag indicating a bill return operation is in progress is reset, a flag indicating that a bill has jammed is set, the emission of the optical sensor (PX) 20 is controlled by on-and-off switching, the front lamp of this device (not shown) is extinguished (step 211), and the operation proceeds to step 223 shown in FIG. 15.

It is checked whether N2 (for example, 30 pulses) have elapsed during the step 212 in FIG. 14, and if N2 (for example, 30 pulses) have elapsed, a process to detect double superposition is performed (step 213).

The process to detect double superposition will be described in detail below with reference to FIG. 25.

In addition, the process to determine the presence of gaps is performed (step 214) if N2 (for example, 30 seconds) have not elapsed during step 212.

The process to determine the presence of gaps will be described in detail below with reference to FIG. 24.

If the process to detect double superposition during step 213 produces an OK result, that is, it is established that there is no double superposition, the operation proceeds to the step 214 process to determine the presence of gaps, and if the step 214 process to determine the presence of gaps produces an OK result, that is, it is established that there are no gaps, the operation proceeds to step 215.

Figure 23:
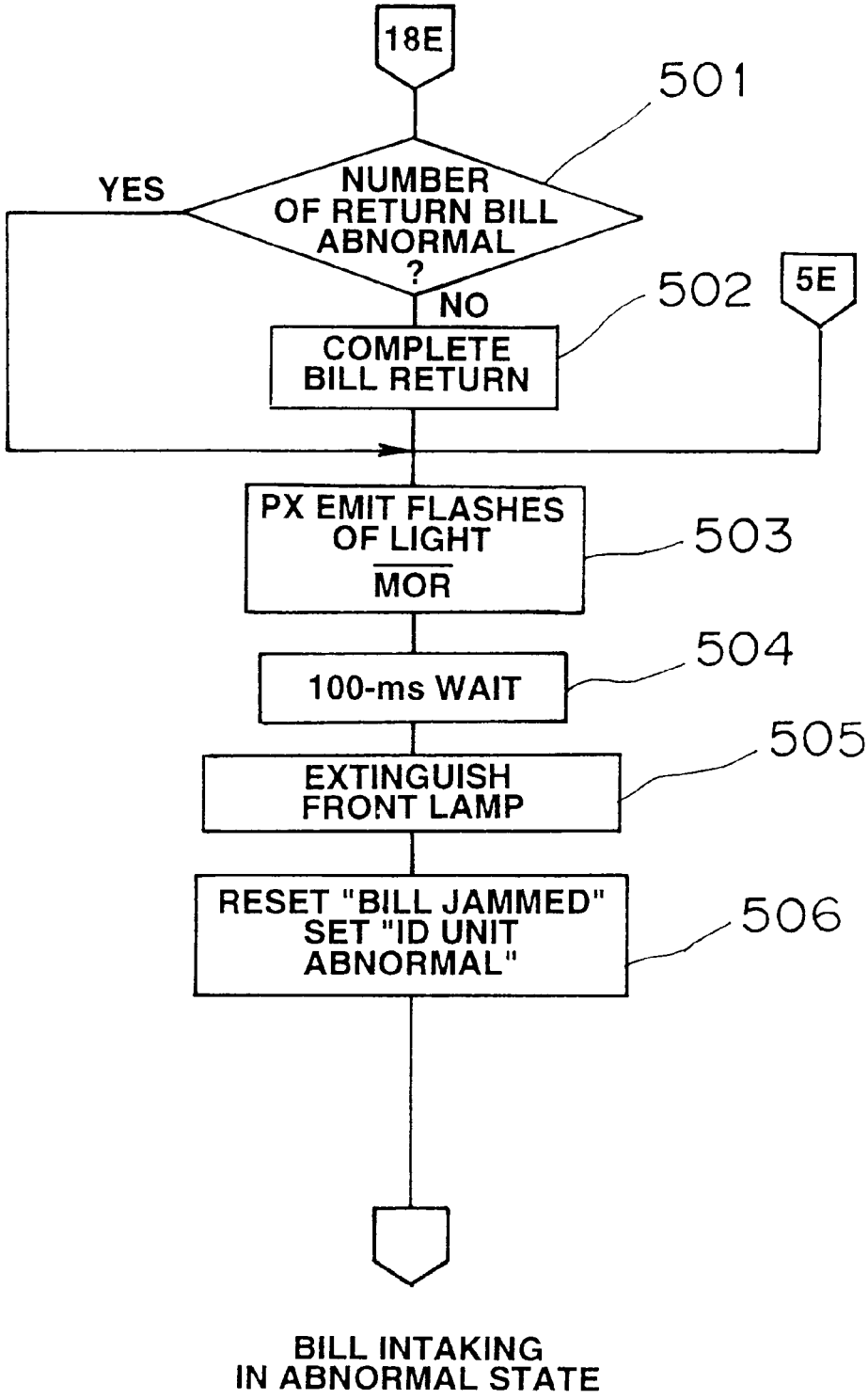
FIG. 23 is a flow chart illustrating the details of how bill intake processing is performed when an abnormal state exists in this embodiment.

The operation proceeds to the step 503 in FIG. 23 if the process to detect double superposition during step 213 produces an NG result, that is, it is established that double superposition has occurred, and if the process to determine the presence of gaps during step 214 produces an NG result, that is, the presence of gaps is established. In this case, designation of an abnormal state is made, and an operation involving bill intake is performed; the processing performed in this case will be described in detail below with reference to FIG. 23.

During step 215, it is checked whether the P2 sensor is on or off.

When the P2 sensor is off under these conditions, it is subsequently checked whether PXR is on or off (step 216); when the PXR is off, it is subsequently checked whether PXC is on or off (step 217); when the PXC is off, it is subsequently checked whether PXL is on or off (step 218); and when the PXL is off, it is subsequently checked whether an inlet sensor P1R is on or off (step 219).

When the inlet sensor P1R is off under these conditions, it is subsequently checked whether the inlet sensor P1L is on or off (step 220); when the inlet sensor P1L is on, it will be checked whether the N1 (for example, 510 pulses) set during step 201 have elapsed (step 221), and if N1 (for example, 510 pulses) have elapsed, the operation proceeds to step 223 shown in FIG. 15.

If it has been established during step 219 that the inlet sensor P1R is on, the operation proceeds to step 221, and if it has been established during step 220 that the inlet sensor P1L is off, the operation proceeds to the step 223 in FIG. 15.

It is also checked whether 3 seconds have elapsed, that is, whether the 3-second timer set during step 204 or the 3-second timer set during step 205 has run out of time if it has been established during step 215 that the P2 sensor is on, if it has been established during step 216 that PXR is on, if it has been established during step 217 that PXC is on, if it has been established during step 218 that PXL is on, and if it has been established during step 221 that N1 (for example, 510 pulses) have not yet elapsed.

If the 3 seconds have not elapsed, the operation proceeds to step 212; and if the 3 seconds have elapsed, the operation proceeds to step 211 on the assumption that a bill has jammed, a flag indicating that a bill return operation is in progress is reset, the flag indicating that a bill has jammed is set, the emission of the optical sensor (PX) 20 is controlled by on-and-off switching, the front lamp of this device (not shown) is extinguished, and the operation proceeds to the step 223 in FIG. 15.

During step 223 shown in FIG. 15, the emission of the optical sensor (PX) 20 is controlled by on-and-off switching, and the bill conveying motor (MOR) 50 is reversed. A waiting period of 100 ms follows (step 224), and the 30-second timer is set (step 225).

A process to determine the presence of gaps is then performed (step 226). The process to determine the presence of gaps will be described in detail below with reference to FIG. 24.

If the process to determine the presence of gaps during step 226 produces an OK result, that is, it is established that there are no gaps, the operation proceeds to the step 227, and 30-second inlet confirmation processing is performed.

The 30-second inlet confirmation processing will be described in detail below with reference to FIG. 26.

When the 30-second inlet confirmation processing performed during step 227 is completed, it is subsequently checked whether the inlet sensor P1L is on or off (step 228), and when the inlet sensor P1L is off, it is subsequently checked whether the inlet sensor P1R is on or off (step 229). When the inlet sensor P1R is off under these conditions, the flag indicating a bill return operation in progress is reset, the flag indicating that a bill has jammed is reset (step 230), and the operation proceeds to the main process shown in FIG. 9.

If the process to determine the presence of gaps during step 226 produces an NG result, that is, it is established that there are gaps, the operation proceeds to step 503 shown in FIG. 23.

In this case, designation of an abnormal state is made, and an operation involving bill intake is performed; the processing performed in this case will be described in detail below with reference to FIG. 23.

In addition, the operation returns to step 226 if it has been established during step 228 that the inlet sensor P1L is on and if it has been established during step 229 that the inlet sensor P1R is on.

Figure 16:
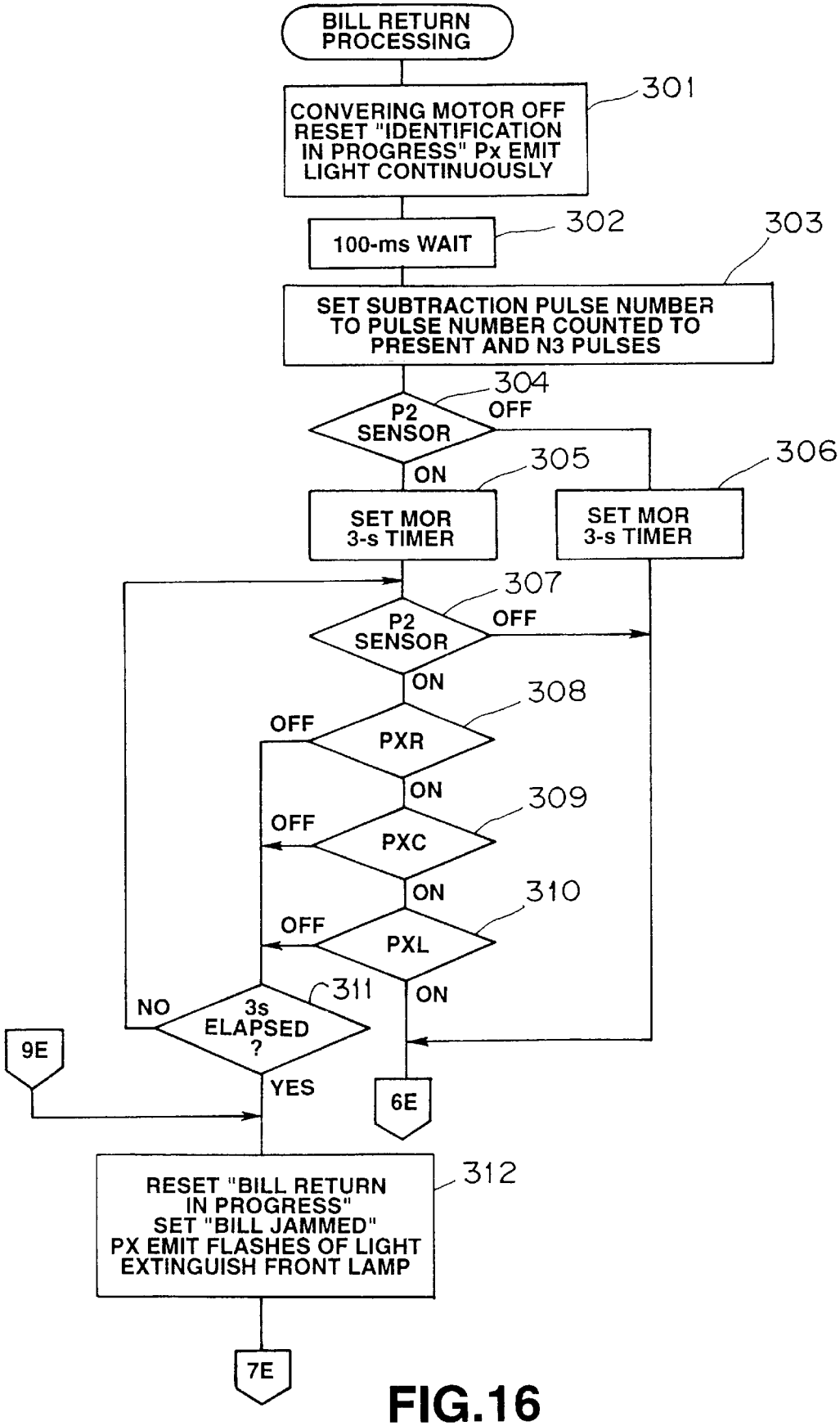
FIGS. 16 through 18 are flow charts illustrating the details of the automatic bill return processing caused by an identification error or the like in this embodiment.
Figure 17:
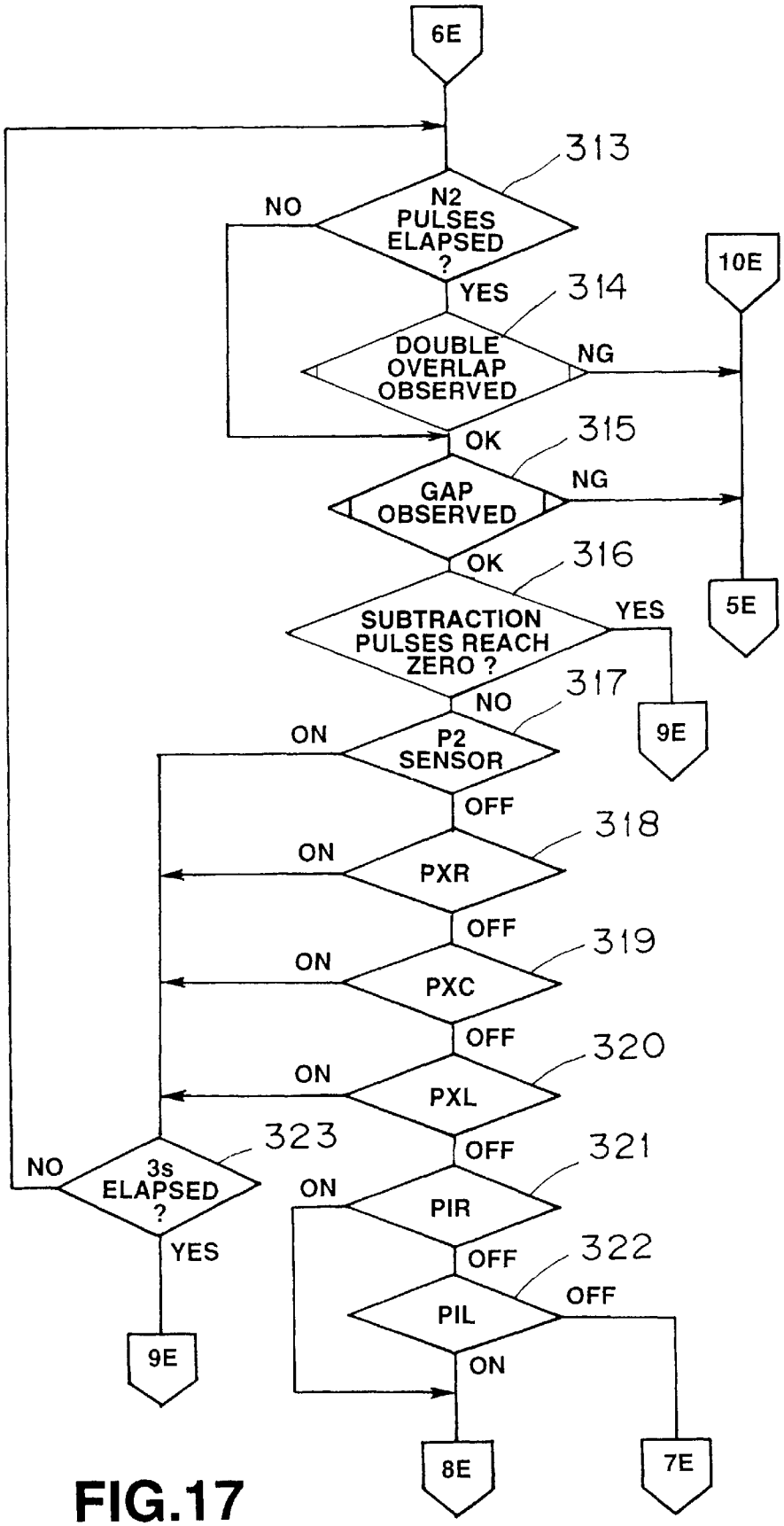
Figure 18:
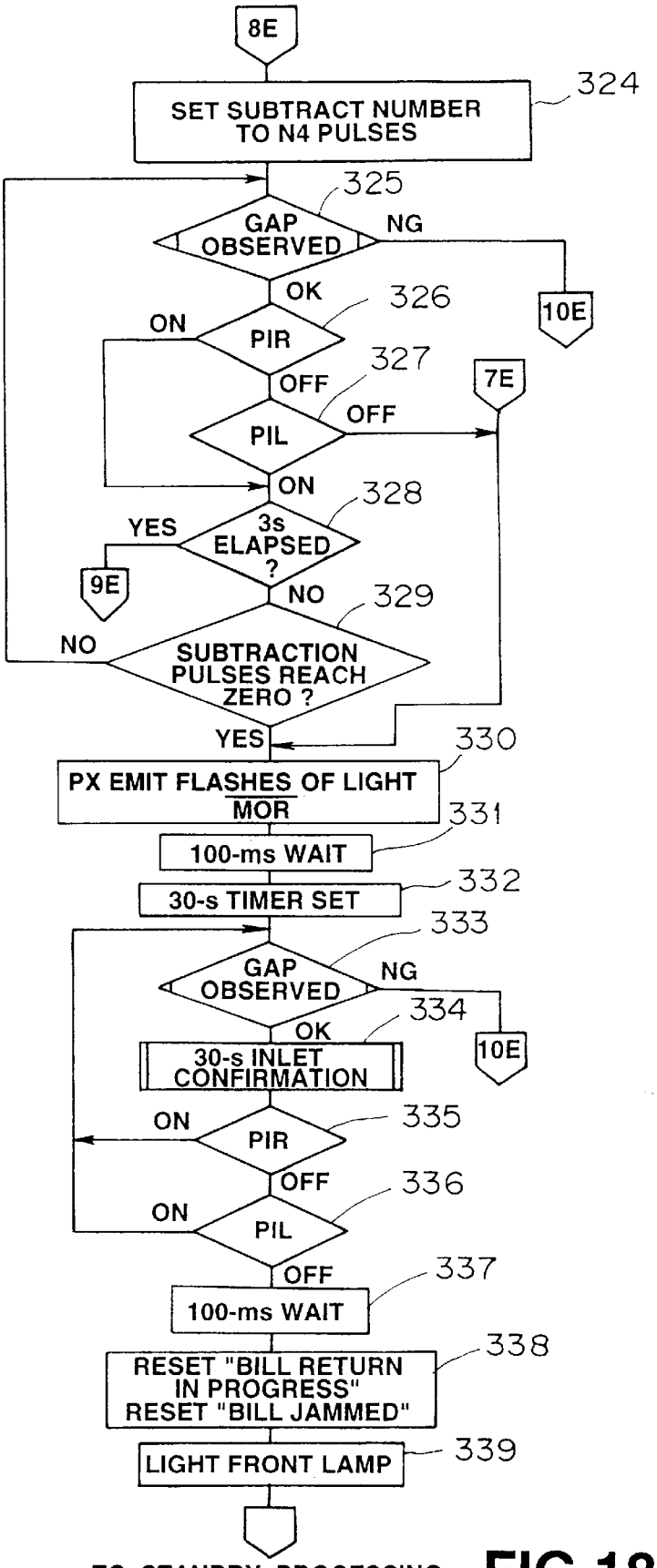

FIGS. 16 through 18 illustrate the details of the automatic bill return processing caused by an identification error or the like, that is, the details of the bill return operation performed during step 125 shown in FIG. 11.

In FIG. 16, the bill conveying motor (MOR) 50 is first switched off, the flag indicating that an identification process is in progress is reset, and the optical sensor (PX) 20, that is, the optical sensors (PXR) 20-1, (PXC) 20-2, and (PXL) 20-3, are controlled so as to be continuously lit (step 301).

A waiting period of 100 ms follows (step 302), and N3 (for example, 150 pulses corresponding to 75 mm) and the number of pulses generated at this moment are then set to the number of subtraction pulses (step 303).

The number of subtraction pulses set in this manner is counted down in the control unit 100 with the aid of the pulses generated in the pulse generation circuit 60 driven by the bill conveying motor 50.

It is then checked whether the P2 sensor is off (step 304), and when the P2 sensor is on, the bill conveying motor (MOR) 50 is operated and the 3-second timer is set (step 305).

It is then checked whether the P2 sensor is on or off (step 307); when the P2 sensor is on, it is subsequently checked whether PXR, that is, the optical sensor 20-1, is on or off (step 308); when the PXR is on, it is subsequently checked whether PXC, that is, the optical sensor 20-2, is on or off (step 309); when the PXC is on, it is subsequently checked whether PXL, that is, the optical sensor 20-3, is on or off (step 310); and when the PXL is on, the operation proceeds to the step 313 in FIG. 17.

If it is established during step 304 that the P2 sensor is off, the bill conveying motor (MOR) 50 is operated, the 3-second timer is set (step 306), and the operation proceeds to the step 313 in FIG. 17.

In addition, the operation proceeds to step 311 if it has been established that PXR is off during step 308, if it has been established that PXC is off during step 309, and if it has been established that PXL is off during step 310; it is checked whether 3 seconds have elapsed, that is, whether the 3-second timer set during step 305 has run out of time; if the 3 seconds have not elapsed, the operation returns to step 307; and if the 3 seconds have elapsed, designation of a bill jam is made, a flag indicating that a bill return operation is in progress is reset, and a flag indicating that a bill has jammed is set, the emission of the optical sensor (PX) 20 is controlled by on-and-off switching, the front lamp of this device (not shown) is extinguished (step 312), and the operation proceeds to step 313 shown in FIG. 17.

It is checked during step 313 shown in FIG. 17 whether N2 (for example, 30 pulses) have elapsed, and a process to detect double superposition is performed (step 314) if N2 (for example, 30 pulses) have elapsed. The process to detect double superposition will be described in detail below with reference to FIG. 25.

In addition, a process to determine the presence of gaps is performed (step 315) if N2 (for example, 30 pulses) have not elapsed during step 313.

The process to determine the presence of gaps will be described in detail below with reference to FIG. 24.

If the process to detect double superposition during step 314 produces an OK result, that is, it is established that there is no double superposition, the operation proceeds to the process to determine the presence of gaps during step 315, and if the process to determine the presence of gaps during step 315 produces an OK result, that is, if it is established that there are no gaps, the operation proceeds to step 316.

The operation proceeds to the step 503 in FIG. 23 if the process to detect double superposition during step 314 produces an NG result, that is, it is established that double superposition has occurred, and if the process to determine the presence of gaps during step 315 produces an NG result, that is, the presence of gaps is established. In this case, designation of an abnormal state is made, and an operation involving bill intake is performed; the processing performed in this case will be described in detail below with reference to FIG. 23.

During step 316, it is checked whether the subtraction pulses set during step 303 reached zero. If the subtraction pulses set during step 303 have become zero under these conditions, the operation proceeds to step 313 on the assumption that bill jamming or continuous return of two bills has occurred, so the flag indicating that a bill has jammed is set, the emission of the optical sensor (PX) 20 is controlled by on-and-off switching, the front lamp of this device (not shown) is extinguished (step 211), and the operation proceeds to step 211 shown in FIG. 17.

If it has been established during step 316 that the subtraction pulses set during step 303 are not zero, it is then checked whether the P2 sensor is on or off (step 317). When the P2 sensor is off under these conditions, it is subsequently checked whether PXR is on or off (step 318); when the PXR is off, it is subsequently checked whether PXC is on or off (step 319); when the PXC is off, it is subsequently checked whether PXL is on or off (step 320); and when the PXL is off, it is subsequently checked whether an inlet sensor P1R is on or off (step 321).

When the inlet sensor P1R is off under these conditions, it is subsequently checked whether the inlet sensor P1L is on or off (step 322); when the inlet sensor P1L is on, the operation proceeds to step 324 shown in FIG. 18; and when the inlet sensor P1L is off, the operation proceeds to step 330 shown in FIG. 18.

If it has been established during step 321 that the inlet sensor P1R is on, the operation proceeds to step 324 shown in FIG. 18. It is also checked (step 323) whether 3 seconds have elapsed, that is, whether the 3-second timer set during step 305 or the 3-second timer set during step 306 has run out of time if it has been established during step 317 that the P2 sensor is on, if it has been established during step 318 that PXR is on, if it has been established during step 319 that PXC is on, and if it has been established during step 320 that PXL is on. If the 3 seconds have not elapsed, the operation returns to step 313; and if the 3 seconds have elapsed, the operation proceeds to step 312 on the assumption that a bill has jammed, the flag indicating that a bill return operation is in progress is reset, the flag indicating that a bill has jammed is set, the emission of the optical sensor (PX) 20 is controlled by on-and-off switching, the front lamp of this device (not shown) is extinguished, and the operation proceeds to the step 330 in FIG. 18.

In step 324 shown in FIG. 18, N4 (for example, 210 pulses) is set to the number of subtraction pulses and a process to determine the presence of gaps is then performed (step 325).

The process to determine the presence of gaps will be described in detail below with reference to FIG. 24.

If the process to determine the presence of gaps during step 325 produces an OK result, that is, it is established that there are no gaps, the operation proceeds to step 326, and if an NG result is obtained, that is, if it is established that there are gaps, the operation proceeds to step 503 shown in FIG. 23. In this case, designation of an abnormal state is made, and an operation involving bill intake is performed; the processing performed in this case will be described in detail below with reference to FIG. 23.

It is checked during step 326 whether the inlet sensor P1R is on or off, and when the inlet sensor P1R is off, it is then checked whether the inlet sensor P1L is on or off (step 327). When the inlet sensor P1L is off under these conditions, the operation proceeds to step 330, and when the inlet sensor P1L is on, the operation proceeds to step 328. The operation proceeds to step 328 if it has been established during step 326 that the inlet sensor P1R is on.

It is checked during step 328 whether 3 seconds have elapsed, that is, whether the 3-second timer set during step 305 or the 3-second timer set during step 306 has run out of time; and if the 3 seconds have elapsed, the operation proceeds to step 312 on the assumption that a bill has jammed, the flag indicating that a bill return operation is in progress is reset, a flag indicating that a bill has jammed is set, the emission of the optical sensor (PX) 20 is controlled by on-and-off switching, the front lamp of this device (not shown) is extinguished, and the operation proceeds to the step 330 in FIG. 18.

In addition, if it is established during step 328 that 3 seconds have not elapsed, it is checked (step 329) whether the subtraction pulses set during step 324 are zero. If the result is not zero, the operation returns to step 325, and if it has been established that the subtraction pulses are zero, the emission of the optical sensor (PX) 20 is controlled by on-and-off switching, and the bill conveying motor (MOR) 50 is reversed (step 330).

A waiting period of 100 ms follows (step 331), and a 30-second timer is set (step 332). A process to determine the presence of gaps is then performed (step 333). The process to determine the presence of gaps will be described in detail below with reference to FIG. 24.

The operation proceeds to step 503 shown in FIG. 23 if the process to determine the presence of gaps during step 226 produces an NG result, that is, if the presence of gaps is established. In this case, designation of an abnormal state is made, and an operation involving bill intake is performed; the processing performed in this case will be described in detail below with reference to FIG. 23. If the process to determine the presence of gaps during step 333 produces an OK result, that is, it is established that there are no gaps, 30-second inlet confirmation processing is performed (step 334). The 30-second inlet confirmation processing will be described in detail below with reference to FIG. 26.

When the 30-second inlet confirmation processing of step 334 is completed, it is checked whether the inlet sensor P1R is on or off (step 335), and when the inlet sensor P1R is off, then it is checked whether the inlet sensor P1L is on or off (step 336). When the inlet sensor P1L is off under these conditions, a waiting period of 100 ms follows (step 336), the flag indicating that a bill return operation is in progress is reset, the flag indicating that a bill has jammed is reset (step 338), the front lamp of this device (not shown) is subsequently switched on (step 339), and the operation proceeds to the standby process shown in FIG. 11.

The operation returns to step 333 if it has been established that the inlet sensor P1R is on during step 335, and that the inlet sensor P1L is on during step 336.

FIGS. 19 through 22 illustrate the details of the bill return processing from the escrow position, that is, the bill return operation of step 133 shown in FIG. 12.

Figure 19:
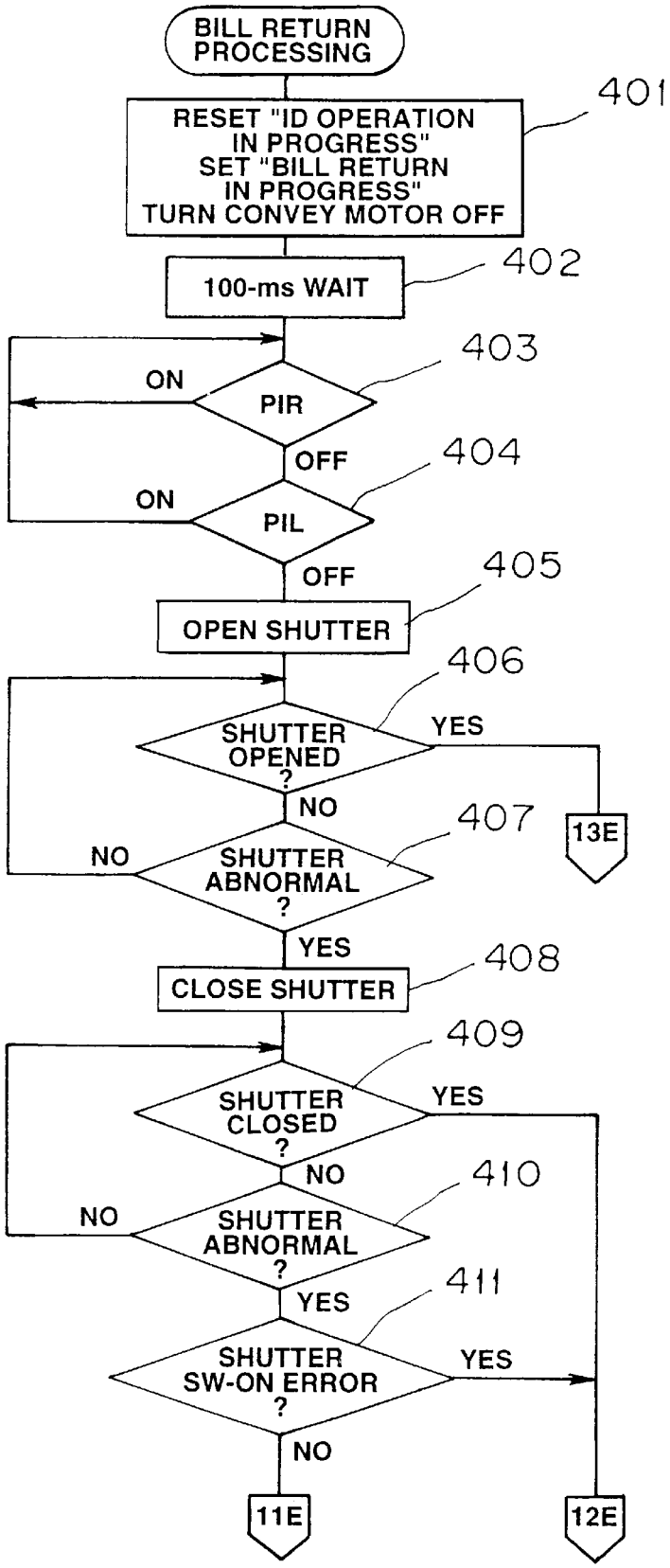
FIGS. 19 through 22 are flow charts illustrating the details of the bill return processing from the escrow position in this embodiment.

In FIG. 19, the flag that indicates an identification operation in process is reset, the flag indicating a bill return operation in process is set, and the bill conveying motor (MOR) 50 is switched off, that is, the bill conveying motor (MOR) 50 is stopped (step 401).

A waiting period of 100 ms follows (step 402), it is checked whether the inlet sensor P1R is on or off (step 403). If the inlet sensor P1R is off, it is checked whether the inlet sensor P1L is on or off (step 404), and the operation proceeds to step 405 when the inlet sensor P1L is off under these conditions. The operation returns to step 403 if it has been established during step 403 that the inlet sensor P1R is on, and if it has been established during step 404 that the inlet sensor P1L is on.

During step 405, the shutter motor 70 is operated, and an operation involving the opening of the shutter 71 is performed (step 405). It is then checked whether the operation involving the opening of the shutter 71 has been completed (step 406). The determination of whether the operation involving the opening of the shutter 71 has been completed is accomplished on the basis of the detection output from a shutter switch (shutter SW; not shown) mounted in conjunction with the shutter 71.

Figure 20:
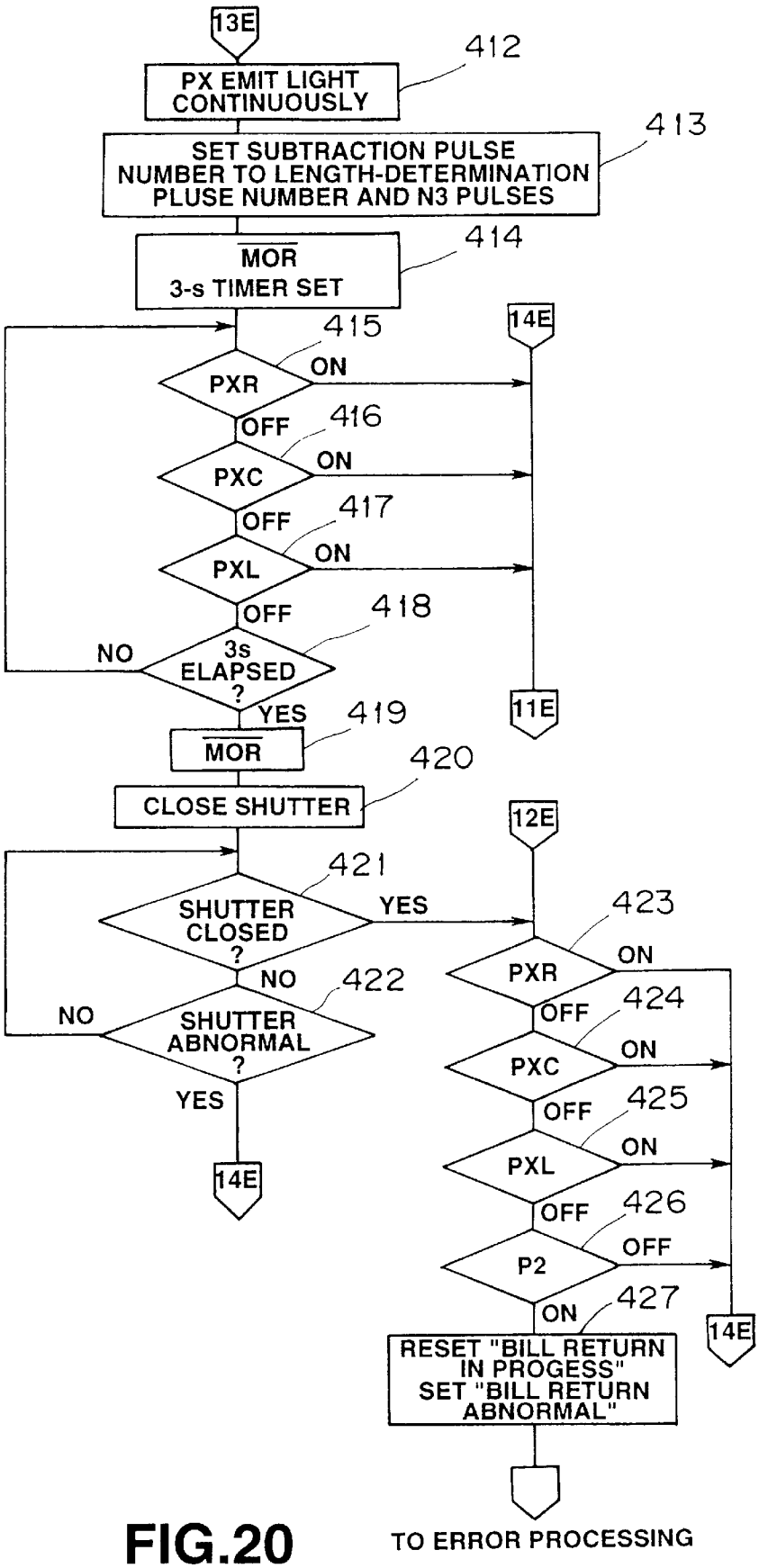

The operation proceeds to step 412 shown in FIG. 20 if it has been established during step 406 that the operation involving the opening of the shutter 71 has been completed.

In addition, the shutter is subsequently checked for abnormalities (step 407) if it has been established during step 406 that the operation involving the opening of the shutter 71 has not been completed. Under these conditions, the operation proceeds to step 406 if it has been established that there are no shutter abnormalities, and the shutter motor 70 is operated and an operation involving the closing of the shutter 71 is performed (step 408) if shutter abnormalities have been found to exist.

It is then checked whether the operation involving the closing of the shutter 71 has been completed (step 409), and the operation proceeds to the step 423 in FIG. 20 if it has been established that the operation involving the closing of the shutter 71 has been completed.

In addition, if it has been established during step 409 that the operation involving the closing of the shutter 71 has not been completed, it is then checked whether there are any shutter abnormalities (step 410); if it has been established under these conditions that there are no shutter abnormalities, the operation returns to step 409; and if shutter abnormalities have been found to exist, it is then checked whether there are shutter-SW on errors (step 411). If shutter-SW-on errors exist under these conditions, the operation proceeds to the step 423 in FIG. 20, and if there are no shutter-SW-on errors, the operation proceeds to the step 428 in FIG. 21.

During step 412 shown in FIG. 20, the emission of the optical sensor (PX) 20 is controlled so as to be continuously lit, and the number of length-determination pulses and 150 pulses (corresponding to 75 mm) are then set to the number of subtraction pulses (step 413). The bill conveying motor (MOR) 50 is then operated, and the 3-second timer is set (step 414).

It is subsequently checked whether PXR is on or off (step 415); when the PXR is off, it is subsequently checked whether PXC is on or off (step 416); when the PXC is off, it is subsequently checked whether PXL is on or off (step 417); and when the PXL is off, it is subsequently checked whether 3 seconds have elapsed, that is, whether the 3-second timer set during step 413 has run out of time (step 418). If the 3 seconds have not elapsed, the operation returns to step 415, and if the 3 seconds have elapsed, the operation proceeds to step 419.

Figure 21:
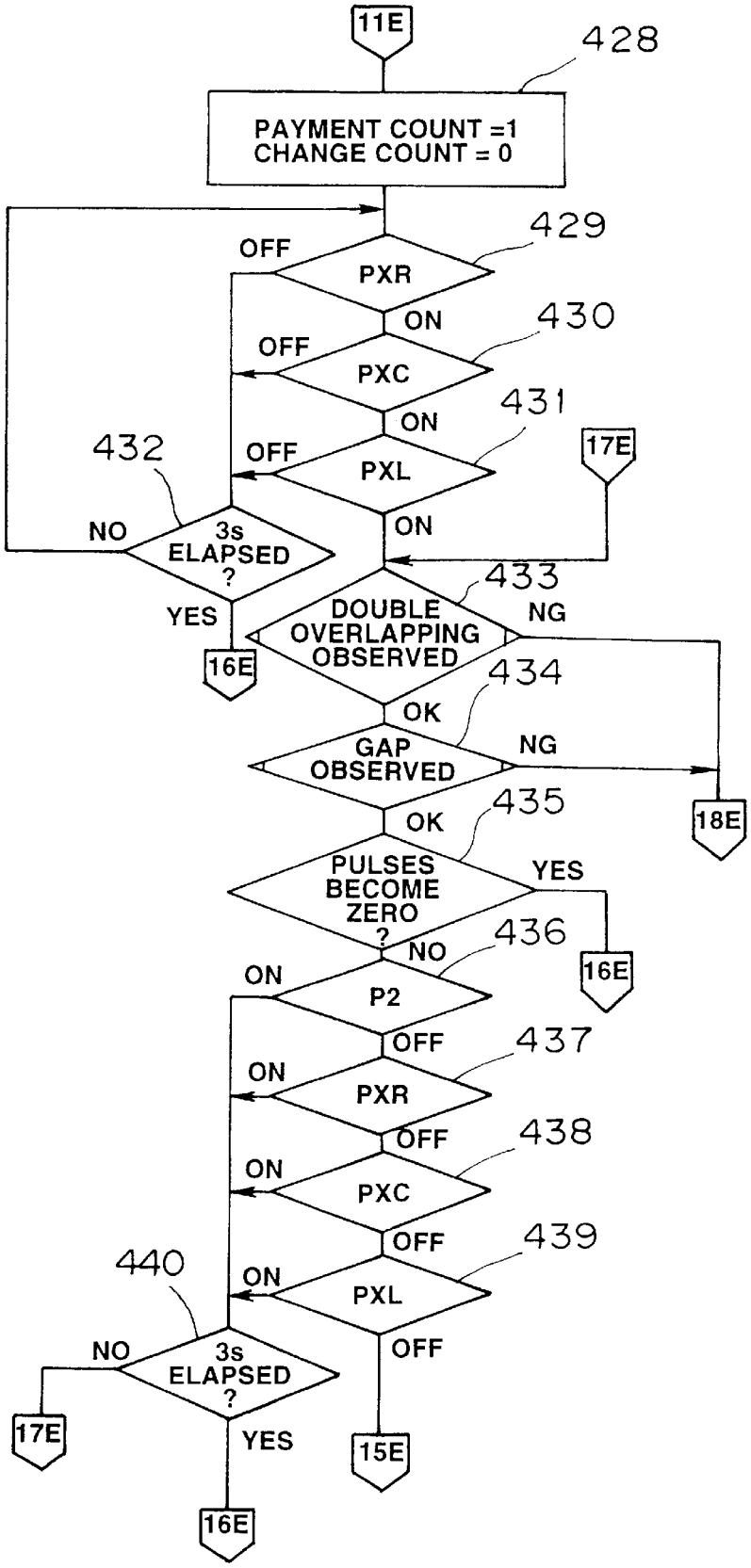

The operation proceeds to the step 428 in FIG. 21 if it has been established during step 415 that PXR is on, if it has been established during step 416 that PXC is on, and if it has been established during step 417 that PXL is on.

During step 419, the bill conveying motor (MOR) 50 is reversed, the shutter motor 70 is subsequently operated, and an operation involving the closing of the shutter 71 is performed (step 420). It is then checked whether the operation involving the closing of the shutter 71 has been completed (step 421), the operation proceeds to step 423 if it has been established that the operation involving the closing of the shutter 71 has been completed, and it is then checked whether there are any shutter abnormalities (step 422) if it has been established that the operation involving the closing of the shutter 71 has not been completed, whereupon the operation returns to step 421 if no shutter abnormalities have been found to exist, and the operation proceeds to the step 428 in FIG. 21 if abnormalities were found to exist.

In addition, it is checked during step 423 whether PXR is on or off; when the PXR is off, it is subsequently checked whether PXC is on or off (step 424); when the PXC is off, it is subsequently checked whether PXL is on or off (step 425); and when the PXL is off, it is subsequently checked whether the P2 sensor is on or off (step 426). When the P2 sensor is on under these conditions, it is assumed that a return irregularity exists, the flag indicating a bill return operation in progress is reset, the flag indicating the bill return irregularity is set (step 427), and predetermined error processing is performed.

The operation proceeds to step 428 shown in FIG. 21 if it has been established during step 423 that PXR is on, if it has been established during step 424 that PXC is on, if it has been established during step 425 that PXL is on, and if it has been established during step 426 that P2 sensor is off.

During step 428 shown in FIG. 21, the number of bills to be paid out is set to 1, and the change count is set to zero (step 428). It is then checked whether PXR is on or off (step 429); when the PXR is on, it is subsequently checked whether PXC is on or off (step 430); when the PXC is on, it is subsequently checked whether PXL is on or off (step 431); and when the PXL is on, the operation proceeds to step 433.

The operation proceeds to step 432 if it has been established during step 429 that PXR is off, if it has been established during step 430 that PXC is off, and if it has been established during step 431 that PXL is off. It is checked whether 3 seconds have elapsed, that is, whether the 3-second timer set during step 414 has run out of time. If the 3 seconds have not elapsed, the operation returns to step 429; and if the 3 seconds have elapsed, the operation proceeds to step 445 on the assumption that a bill has jammed, the flag indicating that a bill return operation is in progress is reset, the flag indicating that a bill has jammed is set, the emission of the optical sensor (PX) 20 is controlled by on-and-off switching, the front lamp of this device (not shown) is extinguished, and the operation proceeds to step 446.

A process to detect double superposition is performed during step 433.

The process to detect double superposition will be described in detail below with reference to FIG. 25.

If the process to detect double superposition during step 433 produces an OK result, that is, it is established that there is no double superposition, a process to determine the presence of gaps is then performed (step 434). The operation proceeds to step 434 if the process to determine the presence of gaps produces an OK result, that is, it is established that there are no gaps.

The operation proceeds to step 501 shown in FIG. 23 if the process to detect double superposition during step 433 produces an NG result, that is, it is established that double superposition has occurred, and if the process to detect double superposition during step 434 produces an NG result, that is, the presence of gaps is established. In this case, designation of an abnormal state is made, and an operation involving bill intake is performed; the processing performed in this case will be described in detail below with reference to FIG. 23.

During step 435, it is checked whether the subtraction pulses set during step 413 have become zero. If the subtraction pulses set during step 413 have become zero under these conditions, the operation proceeds to step 445 on the assumption that bill jamming or continuous return of two bills has occurred, so the flag indicating that a bill return operation is in progress is reset, the flag indicating that a bill has jammed is set, the emission of the optical sensor (PX) 20 is controlled by on-and-off switching, the front lamp of this device (not shown) is extinguished (step 211), and the operation proceeds to step 446.

If it has been established during step 435 that the subtraction pulses set during step 413 are not zero, it is then checked whether the P2 sensor is on or off (step 436). When the P2 sensor is off under these conditions, it is subsequently checked whether PXR is on or off (step 437); when the PXR is off, it is subsequently checked whether PXC is on or off (step 438); when the PXC is off, it is subsequently checked whether PXL is on or off (step 439); and when the PXL is off, the operation proceeds to step 441 shown in FIG. 22.

The operation proceeds to step 440 if it has been established during step 436 that the P2 sensor is on, if it has been established during step 437 that PXR is on, if it has been established during step 438 that PXC is on, and if it has been established during step 439 that PXL is on. It is checked whether 3 seconds have elapsed, that is, whether the 3-second timer set during step 414 has run out of time. If the 3 seconds have not elapsed, the operation returns to step 433, and if the 3 seconds have elapsed, the operation proceeds to step 445 shown in FIG. 22 on the assumption that a bill has jammed, the flag indicating that a bill return operation is in progress is reset, the flag indicating that a bill has jammed is set, the emission of the optical sensor (PX) 20 is controlled by on-and-off switching, the front lamp of this device (not shown) is extinguished, and the operation proceeds to step 446.

Figure 22:
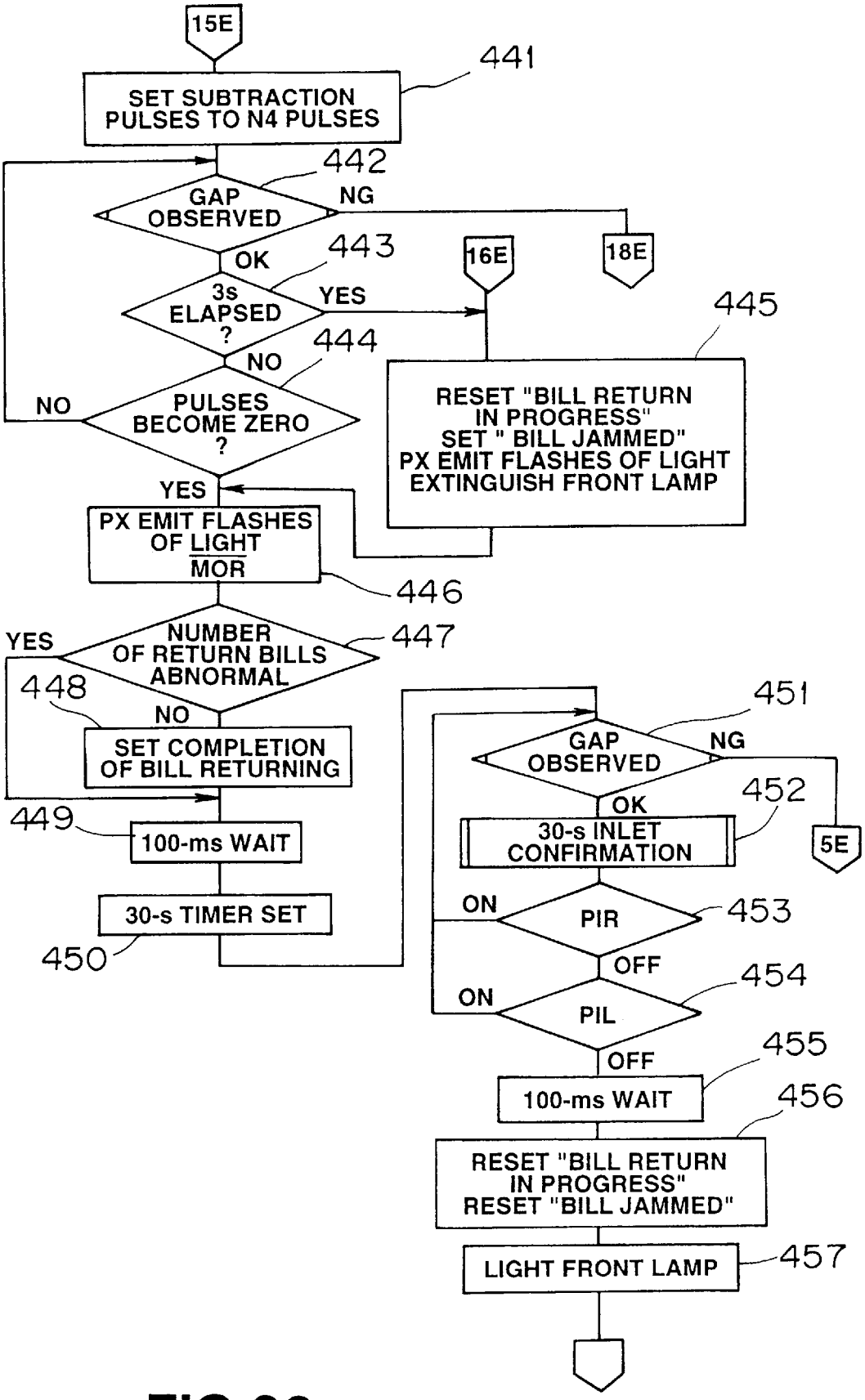

During step 441 shown in FIG. 22, N4 (for example, 210 pulses) is set to the number of subtraction pulses (step 441). A process to determine the presence of gaps is then performed (step 442). The process to determine the presence of gaps will be described in detail below with reference to FIG. 24.

The operation proceeds to step 501 shown in FIG. 23 if the process to determine the presence of gaps during step 442 produces an NG result, that is, the presence of gaps is established. In this case, designation of an abnormal state is made, and an operation involving bill intake is performed; the processing performed in this case will be described in detail below with reference to FIG. 23.

The operation proceeds to step 443 if the process to determine the presence of gaps during step 442 produces an OK result, that is, it is established that there are no gaps.

It is checked during step 443 whether 3 seconds have elapsed, that is, whether the 3-second timer set during step 414 has run out of time. If the 3 seconds have not elapsed, the operation proceeds to step 444; and if the 3 seconds have elapsed, the operation proceeds to step 445 on the assumption that a bill has jammed, the flag indicating that a bill return operation is in progress is reset, the flag indicating that a bill has jammed is set, the emission of the optical sensor (PX) 20 is controlled by on-and-off switching, the front lamp of this device (not shown) is extinguished, and the operation proceeds to step 446.

During step 444, it is checked whether the subtraction pulses set during step 441 have become zero. The operation returns to step 442 if it is established under these conditions that the subtraction pulses set during step 441 are not zero, and the operation proceeds to step 446 if the subtraction pulses set during step 441 have become zero.

The emission of the optical sensor (PX) 20 during step 446 is controlled by on-and-off switching, and the bill conveying motor (MOR) 50 is reversed. A waiting period of 100 ms follows (step 449), and a 30-second timer is set (step 450). A process to determine the presence of gaps is then performed (step 451).

The process to determine the presence of gaps will be described in detail below with reference to FIG. 24. The operation proceeds to step 503 shown in FIG. 23 if the process to determine the presence of gaps during step 451 produces an NG result, that is, the presence of gaps is established. In this case, designation of an abnormal state is made, and an operation involving bill intake is performed; the processing performed in this case will be described in detail below with reference to FIG. 23.

If the process to determine the presence of gaps during step 451 produces an OK result, that is, it is established that there are no gaps, 30-second inlet confirmation processing is performed (step 452).

The 30-second inlet confirmation processing will be described in detail below with reference to FIG. 26.

When the 30-second inlet confirmation processing of step 452 is completed, then it is checked whether the inlet sensor P1R is on or off (step 453), and when the inlet sensor P1R is off, it is checked whether the inlet sensor P1L is on or off (step 454). When the inlet sensor P1L is off under these conditions, a waiting period of 100 ms follows (step 455), the flag indicating that a bill return operation is in progress is reset, the flag indicating that a bill has jammed is reset (step 456), the front lamp of this device (not shown) is subsequently switched on (step 457), and the operation proceeds to the standby process shown in FIG. 12.

The operation returns to step 451 if it has been established that the inlet sensor P1R is on during step 453 and that the inlet sensor P1L is on during step 454. FIG. 23 illustrates the bill intake processing performed in the event of an abnormal state. It is first checked whether there are any abnormalities in the number of bills to be paid out (step 501), the operation proceeds to step 503 if there are abnormalities in the number of bill returns, and the completion of bill return is confirmed (step 502) and the operation proceeds to step 503 if there are no abnormalities in the number of bill returns.

The emission of the optical sensor (PX) 20 during step 503 is controlled by on-and-off switching, and the bill conveying motor (MOR) 50 is reversed. A waiting period of 100 ms follows (step 504), the front lamp of the device (not shown) is extinguished (step 505), the flag indicating that a bill has jammed is reset, the flag indicating the presence of abnormal state in the identification unit is set (step 506), an operation for incorporating bills in the event of an abnormal state is performed by introducing the bills into the stacking unit and forcibly stacking them there.

Figure 24:
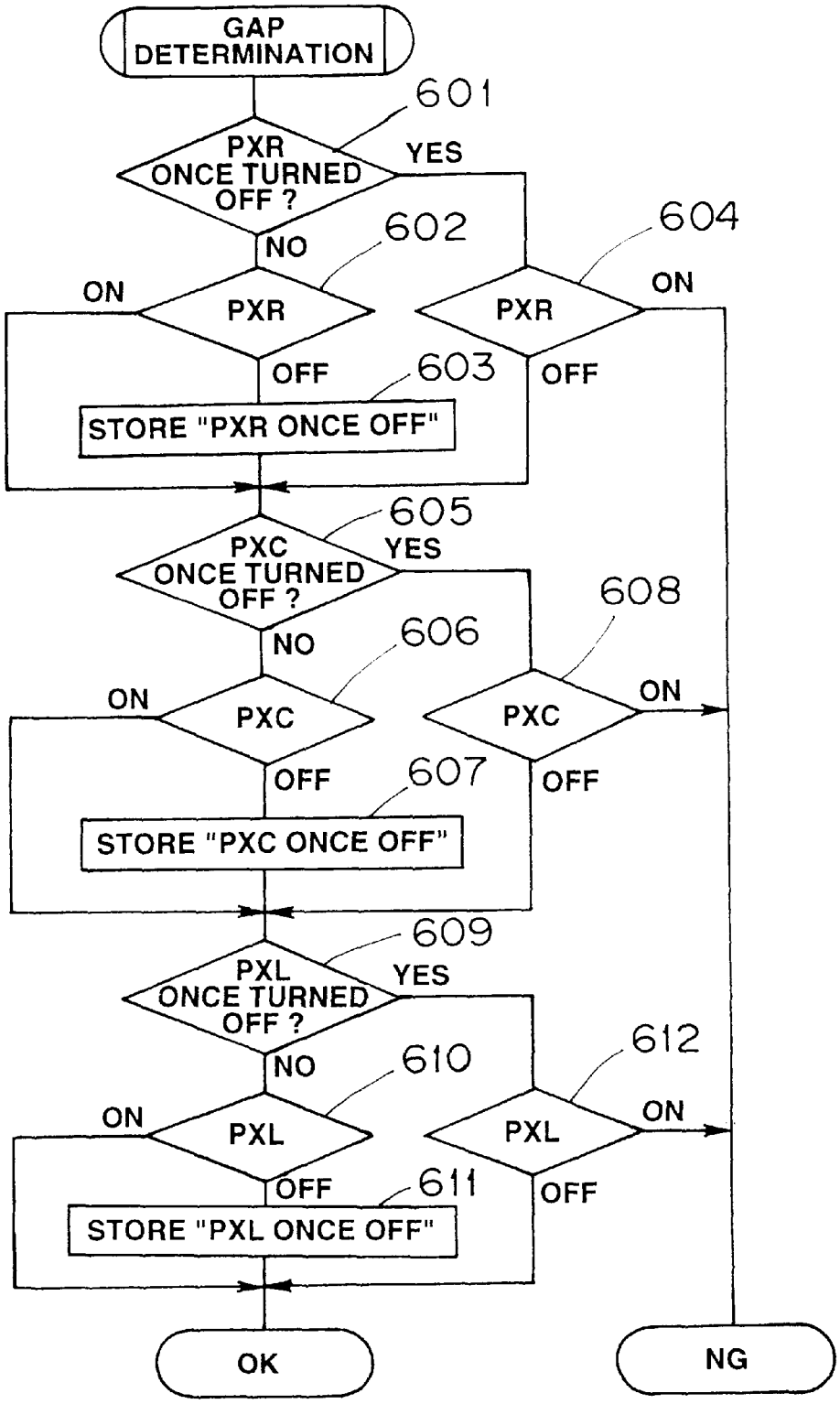
FIG. 24 is a flow chart illustrating the details of how a process to determine the presence of intervals is performed in this embodiment.

FIG. 24 shows the details of the process to determine the presence of gaps.

In the course of the process to determine the presence of gaps, it is first checked (step 601) whether PXR has been switched off once. If the PXR has not been switched off once, it is then checked (step 602) whether the PXR is on or off. If the PXR is on, the operation proceeds to step 605, and if the PXR is off, information concerning the fact that the PXR has been switched off once is stored (step 603) and the operation proceeds to step 605.

In addition, if the PXR has been switched off once during step 601, it is checked (step 604) whether the PXR is switched on or off. If the PXR is on, an NG result is produced, that is, it is established that there are gaps; and if the PXR is off, the operation proceeds to step 605. It is checked during step 605 whether PXC has been switched off once. If the PXC has not been switched off once, it is then checked (step 606) whether the PXC is on or off. If the PXC is on, the operation proceeds to step 609, and if the PXC is off, information concerning the fact that the PXC has been switched off once is stored (step 607) and the operation proceeds to step 609. In addition, if PXC has been switched off once during step 605, it is checked (step 608) whether the PXC is on or off. An NG result is produced, that is, it is established that there are gaps, if the PXC is on; and the operation proceeds to step 609 if the PXC is off.

During step 609, it is checked whether PXL has been switched off once. If the PXL has not been switched off once, it is then checked whether the PXL is on or off (step 610), and if the PXL is on, an OK result is produced, that is, it is concluded that there are no gaps, whereas if the PXL is off, information concerning the fact that the PXL has been switched off once is stored (step 611), and an OK result is produced, that is, it is concluded that there are no gaps.

In addition, if PXL has been switched off once during step 609, it is checked whether the PXL is on or off (step 612), and if the PXL is on, an NG result is produced, that is, it is concluded that gaps are present, whereas when the PXL is off, an OK result is produced, that is, it is concluded that there are no gaps.

Figure 25:
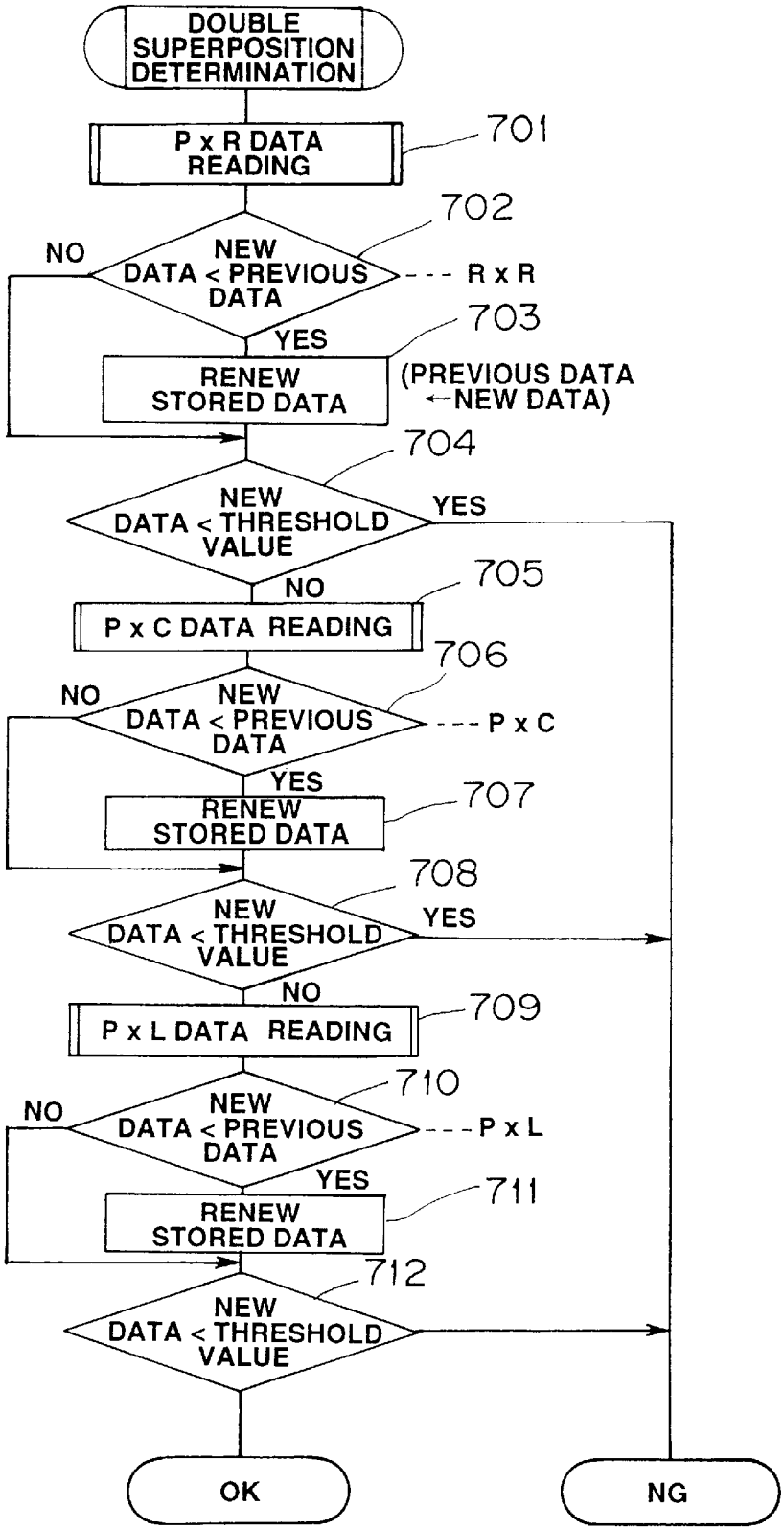
FIG. 25 is a flow chart illustrating the details of how a process to detect double superposition is performed in this embodiment.

FIG. 25 illustrates the details of the process to detect double superposition. The process to detect double superposition involves first reading (step 701) data PxR, which are the output data of PXR, and then comparing (step 702) new data and previous data. When the condition "new data<previous data" is not satisfied in this case, the operation proceeds to step 704, and when the condition "new data<previous data" is satisfied, a recorded data update process in which previous data is replaced with new data is performed (step 703), and the operation proceeds to step 704.

During step 704, the new data are compared with preset threshold values, and when the new data are lower than the threshold values, an NG result is produced, that is, it is concluded that double superposition has occurred, whereas when the new data are not lower than the threshold values, the operation proceeds to step 705. During step 705, a process aimed at reading data PxC, which are the output data of PXC, is performed, and new data and previous data are then compared (step 706). When the condition "new data<previous data" is not satisfied in this case, the operation proceeds to step 708, and when the condition "new data<previous data" is satisfied, a recorded data update process in which previous data is replaced with new data is performed (step 707), and the operation proceeds to step 708.

During step 708, the new data are compared with preset threshold values, and when the new data are lower than the threshold values, an NG result is produced, that is, it is concluded that double superposition has occurred, whereas when the new data are not lower than the threshold values, the operation proceeds to step 709.

During step 709, a process aimed at reading data PxL, which are the output data of PXL, is performed, and new data and previous data are then compared (step 710). When the condition "new data<previous data" is not satisfied in this case, the operation proceeds to step 712, and when the condition "new data<previous data" is satisfied, a recorded data update process in which previous data is replaced with new data is performed (step 711), and the operation proceeds to step 712.

During step 712, the new data are compared with preset threshold values, and when the new data are lower than the threshold values, an NG result is produced, that is, it is concluded that double superposition has occurred, whereas when the new data are not lower than the threshold values, an OK result is produced, that is, it is concluded that there is no double superposition.

Figure 26:
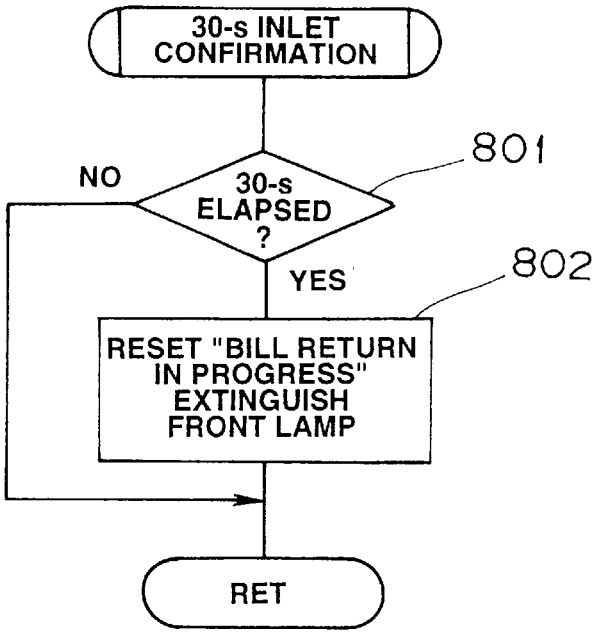
FIG. 26 is a flow chart illustrating the details of how 30-second inlet confirmation processing is performed in this embodiment.

FIG. 26 illustrates the details of 30-second inlet confirmation processing.

The 30-second inlet confirmation processing involves first checking whether 30 seconds have elapsed (step 801), and if 30 seconds have elapsed, the flag indicating that a bill has jammed is set, the flag indicating that a bill return operation is in progress is reset, the front lamp of this device (not shown) is extinguished (step 802), and a return is performed. The return is performed directly if it has been established during step 801 that 30 seconds have not yet elapsed.

This embodiment thus makes it possible to reliably prevent tampering using bills introduced into the stacking unit because the configuration is such that if the number of the returned bills is two or more during bill return, the returned bills are identified as abnormally returned bills by an abnormally returned bill detection means, and if returned bills are identified as abnormally returned bills by the abnormally returned bill detection means, predetermined abnormal-state processing is performed.

Another embodiment of this invention will now be described in detail.

Figure 27:
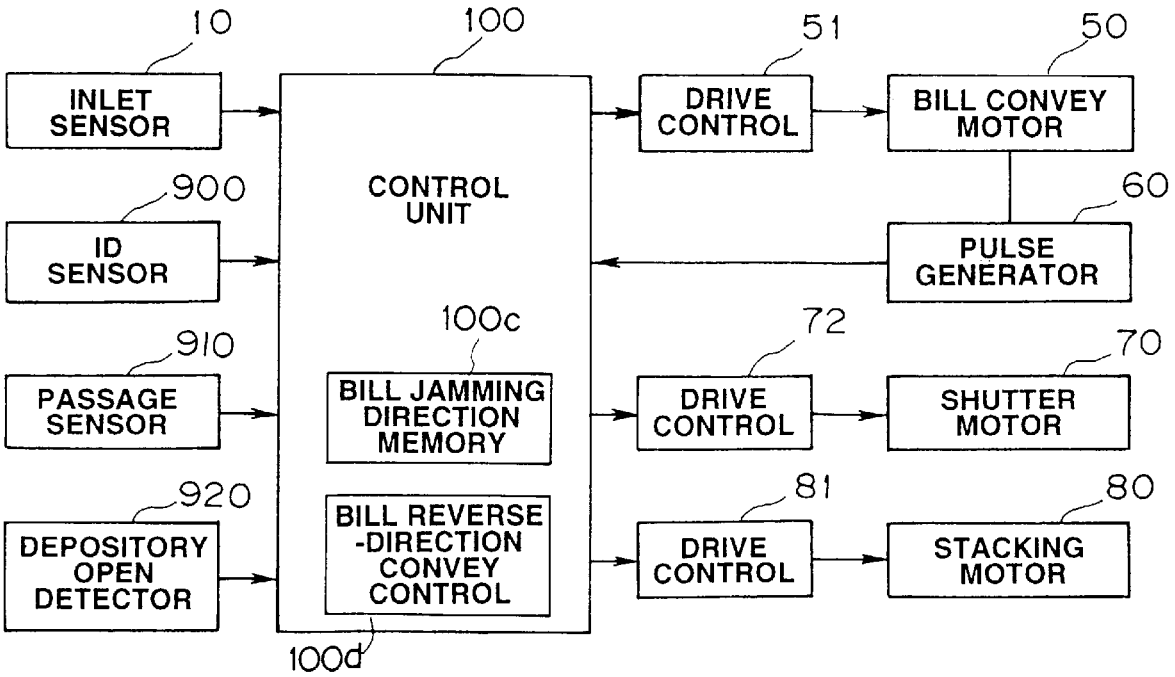
FIG. 27 is a block diagram illustrating the overall structure of the control system of the bill processing device for another embodiment of this invention.
Figure 28:
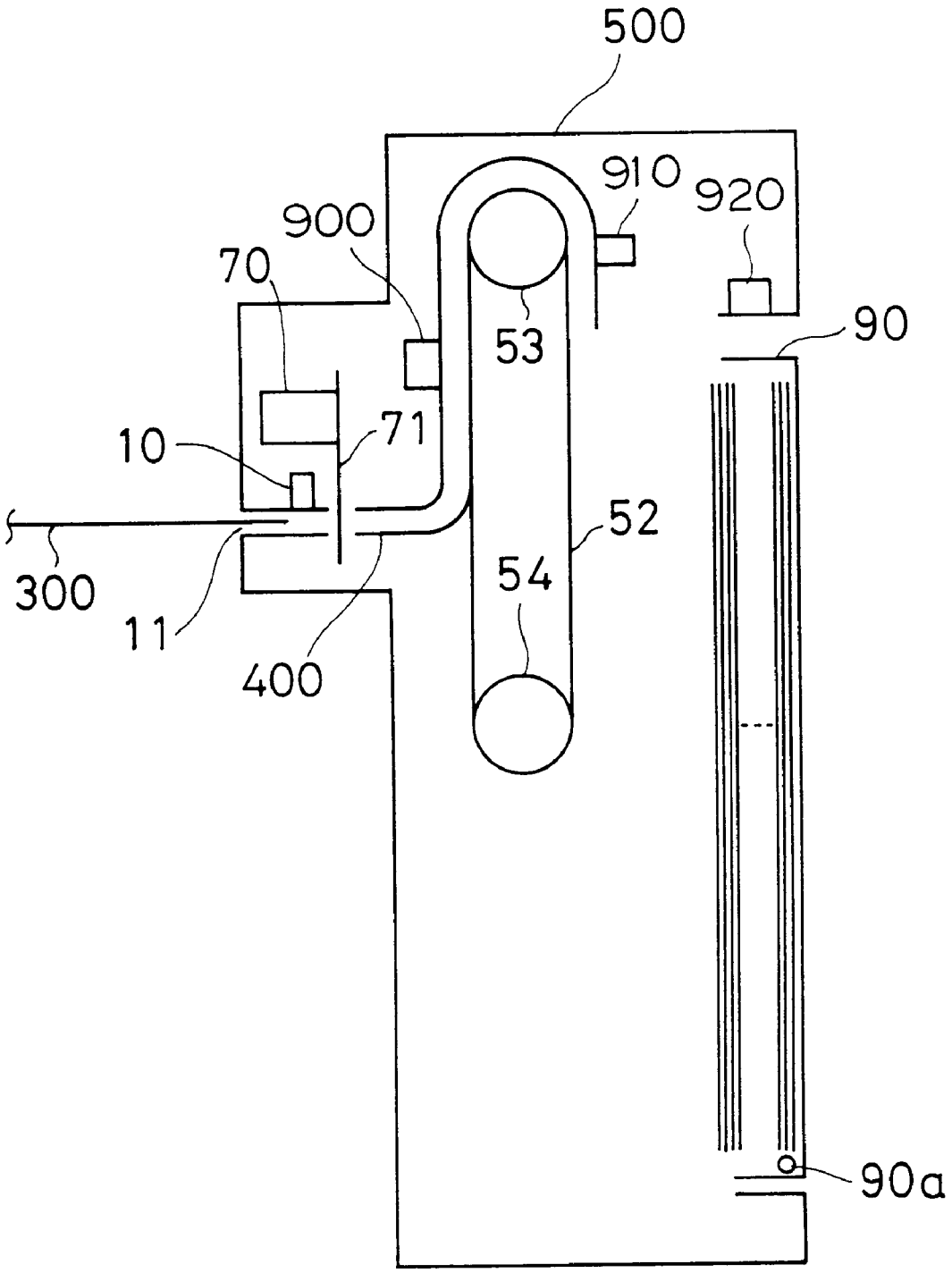
FIG. 28 is a side view illustrating a schematic structure of the bill processing device for the other embodiment of this invention.

FIG. 27 is a block diagram illustrating the overall structure of the control system of the bill processing device for another embodiment of this invention, and FIG. 28 is a side view illustrating a schematic structure of the bill processing device for the other embodiment of this invention. The same components as those described with reference to FIGS. 1 through 8 are designated with identical symbols.

In FIGS. 27 and 28, an inlet sensor 10 that detects a bill 300 inserted into a bill insertion slot 11 is installed in the bill processing device 500 near the bill insertion slot 11. The detection output from the inlet sensor 10 is input to a control unit 100, the control unit 100 drives a bill conveying motor 50 via a drive circuit 51 on the basis of the detection output of the inlet sensor 10, the operation of a conveyance mechanism (not shown in its entirety) is thus initiated, and the bill 300 inserted into the bill insertion slot 11 is conveyed along a bill conveying channel 400.

As used herein, a bill conveyor belt 52 suspended between a pulley 53 and a pulley 54 comprises a portion of the aforementioned conveyance mechanism, and the bill 300 that has reached the mounting position of the bill conveyor belt 52 is conveyed by the bill conveyor belt 52 along the bill conveying channel 400.

An inlet shutter 71 is installed in the bill conveying channel 400. The inlet shutter 71 opens and closes the bill conveying channel 400 by being moved up and down by a shutter motor 70; the shutter motor 70 is driven by the control unit 100 via a drive circuit 72.

In addition, the bill conveying channel 400 is equipped with an identification sensor 900 designed for bill identification and composed of an optical sensor and a magnetic sensor.

The identification sensor 900 reads the necessary data from the bill 300 that is conveyed along the bill conveying channel 400. The output from the identification sensor 900 is input to the control unit 100, and the control unit 100 establishes the authenticity of the bill 300 on the basis of the output from the identification sensor 900.

In addition, the bill conveying channel 400 is equipped with a passage sensor 910 for detecting the passage of the bill 300 that has travelled past the mounting position of the identification sensor 900. The detection output from the passage sensor 910 is applied to the control unit 100.

A stacker 90 for accumulating the bills 300 that have been conveyed through the bill conveying channel 400 is installed in the terminal-point portion of the bill conveying channel 400. The bills 300 that have been conveyed through the bill conveying channel 400 are stacked in the stacker 90 using a stacking mechanism (not shown) driven by a stacking motor 80.

The stacking motor 80 is driven via a drive circuit 81 by the stacking commands from the control unit 100.

In addition, the bill conveying motor 50 is equipped with a pulse generator 60 that generates pulses in synchronism with the rotation of the bill conveying motor 50, the pulses generated by the pulse generator 60 are applied to the control unit 100, and the control unit 100 determines the position of the bill in the bill conveying channel 400 and the presence of a jammed bill in the bill conveying channel 400 by counting the pulses.

Figure 29:
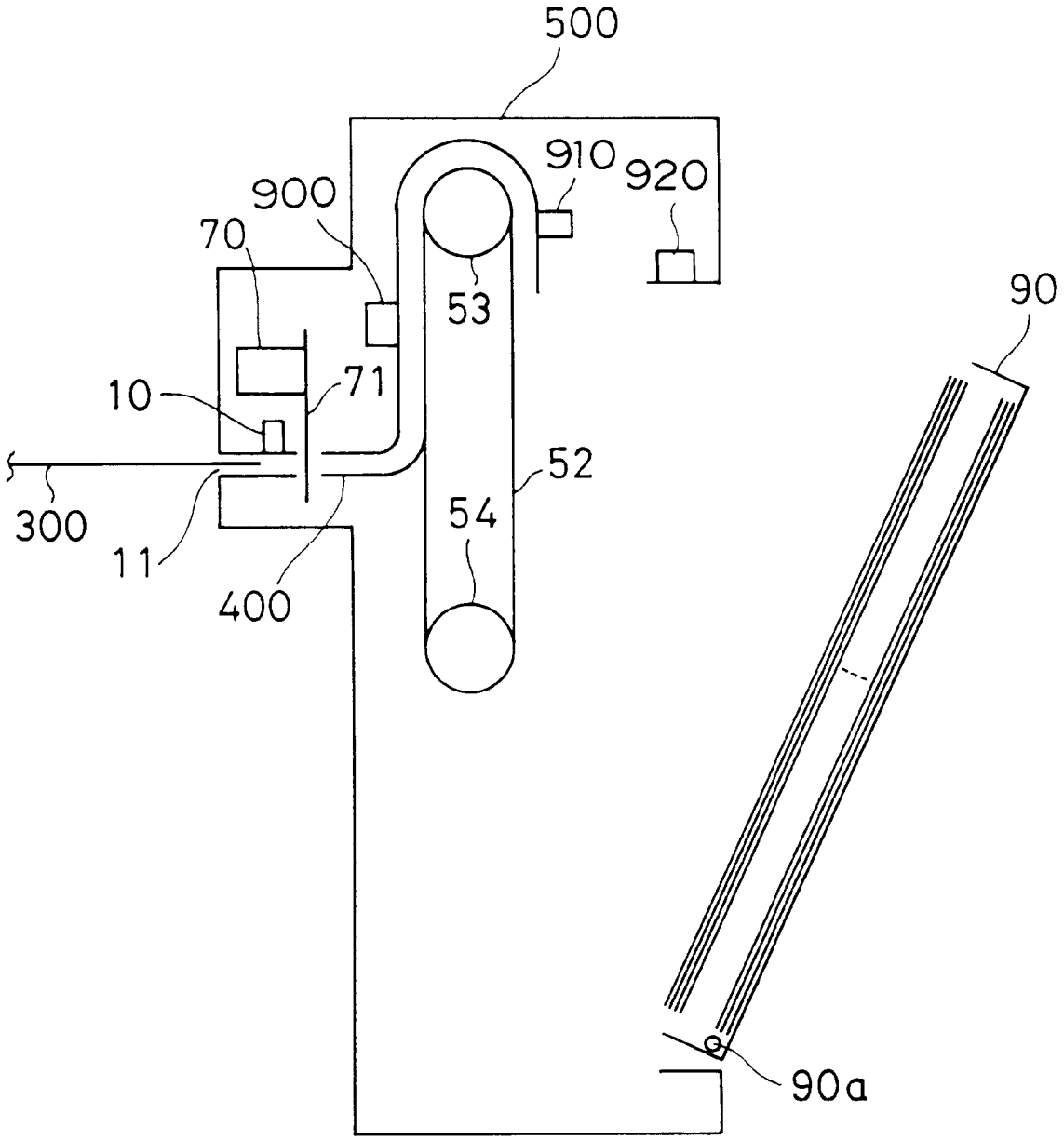
FIG. 29 is a side view illustrating the open state of the stacker shown in FIG. 28.

In addition, the stacker 90 has a structure that allows it to rotate about a shaft 90*a*, so when a bill that has been stacked in the stacker 90 is to be taken out, the stacker 90 is rotated in a manner such as that shown in FIG. 29, and the bill that has been stacked in the stacker 90 is taken out. With this structure, the stacker 90 can be rotated in a manner such as that shown in FIG. 29, even when a bill has jammed in the bill conveying channel 400, with the result that the bill conveying channel 400 is partially opened, and the jammed bill is taken out.

The opening and closing of the stacker 90 is detected under these conditions by a bill depository opening and closing detection sensor 920, and the detection output from the bill depository opening detection sensor 920 is applied to the control unit 100.

In addition, the control unit 100 comprises a bill jamming direction memory unit 100*c* that stores the jamming direction of the bill if bill jamming occurs in the bill conveying channel 400, and a bill reverse-direction conveyance control unit 100*d* that conveys, for a predetermined time, the jammed bill in the bill conveying channel 400 in the direction opposite to the bill jamming direction stored in the bill jamming direction memory unit 100*c*.

The operation of the bill processing device of this embodiment will now be outlined with reference to FIG. 28.

As shown in FIG. 28, when a bill 300 is inserted into the bill insertion slot 11, the bill 300 is first detected by the inlet sensor 10. When the insertion of the bill 300 is detected by the inlet sensor 10, the shutter motor 70 is driven by the detection output from the inlet sensor 10, the shutter 71 is moved upward, and the bill conveying channel 400 is opened.

In addition, the bill conveying motor 50 is driven by the detection output from the inlet sensor 10, and the bill 300 inserted into the bill insertion slot 11 is introduced into the device by a conveyance mechanism (not shown) and conveyed upward by the bill conveyor belt 52. An operation involving the identification of the bill 300 by the identification sensor 900 is started when the leading edge of the bill 300 reaches the mounting position of the identification sensor 900.

The structure adopted in this embodiment is such that the intermittent determination of a bill 300 is accomplished based on the detection output of the identification sensor 900.

Specifically, this embodiment involves dividing a bill 300 into multiple points in the longitudinal direction of the bill, sampling the detection output of the identification sensor 900 at these multiple points, successively comparing the sampled values with the predetermined criteria (identification data) corresponding to the aforementioned multiple points, identifying the bill as counterfeit the moment a sampled value falls outside the allowable range of identification data, and reversing the bill conveying motor 50, thus returning the bill identified as counterfeit to the bill insertion slot 11.

When the leading edge of the bill 300 conveyed by the conveyor belt 52 along the bill conveying channel 400 reaches the mounting position of the passage sensor 910, the passage sensor 910 is switched on, and when the bill 300 advances further and it is established that the bill 300 is authentic, the shutter motor 70 is operated, the shutter 71 is moved downward, and the bill conveying channel 400 is closed.

The bill 300 then advances further along the bill conveying channel 400, and when the back edge of the bill 300 reaches the mounting position of the passage sensor 910, the passage sensor 910 is switched off, and the bill 300 reaches the state of temporary holding (the escrow state).

When a stacking command is received from the control unit 100 in this state, the bill 300 is advanced further by being driven by the bill conveyor belt 52, and is stacked in the stacker 90 by a stacking mechanism (not shown). When a bill has jammed in the bill conveying channel 400 in the course of the aforementioned operation, the control unit 100 performs detection on the basis of the detection output from the identification sensor 900 and passage sensor 910, and on the basis of the enumeration value of the pulses generated by the pulse generator 60. Predetermined abnormal-state display is carried out with the aid of a display means (not shown). As shown in FIG. 29, the stacker 90 is opened in this case, and an operation aimed at taking out the jammed bill is performed.

When bill jamming is detected by the control unit 100 in this embodiment, information concerning the direction in which the bill is jammed at this time is stored in the bill jamming direction memory unit 100*c* of the control unit 100. The bill jamming direction can be determined based on the direction in which the bill is conveyed immediately before the bill jamming has been detected by the control unit 100. The fact that the stacker 90 has subsequently been opened to remove the jammed bill is detected based on the detection output of the bill depository opening and closing detection sensor 920, whereupon the bill reverse-direction conveyance control unit 100*d* of the control unit 100 performs bill reverse-direction conveyance control by conveying for a predetermined time the jammed bill in the bill conveying channel 400 in the direction opposite to the bill jamming direction stored in the bill jamming direction memory unit 100*c*.

Specifically, the bill reverse-direction conveyance control involves conveying the bill for a predetermined time toward the bill insertion slot 11, that is, in the direction of bill return, if bill jamming direction stored in the bill jamming direction memory unit 100*c* originates at the stacker 90 side, that is, coincides with the bill insertion direction; and involves conveying the bill for a predetermined time toward the stacker 90 side, that is, in the direction of bill insertion, if the bill jamming direction stored in the bill jamming direction memory unit 100*c* originates at the bill insertion slot 11 side, that is, coincides with the bill return direction.

This allows the jammed bill to be ejected through the bill insertion slot 11 or into the stacker 90, and the removal of the jammed bill is facilitated.

Specifically, the leading edge of a bill usually becomes folded or wrinkled in the bill jamming direction when a bill jams in the bill conveying channel 400, making it difficult to convey the bill in the bill jamming direction. In the direction opposite to the bill jamming direction, however, no folding or wrinkling occurs, and conveyance is possible.

In view of the above, this embodiment facilitates the removal of a jammed bill by conveying the bill in the direction opposite to the bill jamming direction when a bill that has jammed in the bill conveying channel is to be removed.

The details of the processing performed when bill jamming has occurred in this embodiment will now be described in detail with reference to FIGS. 30 to 32.

Figure 30:
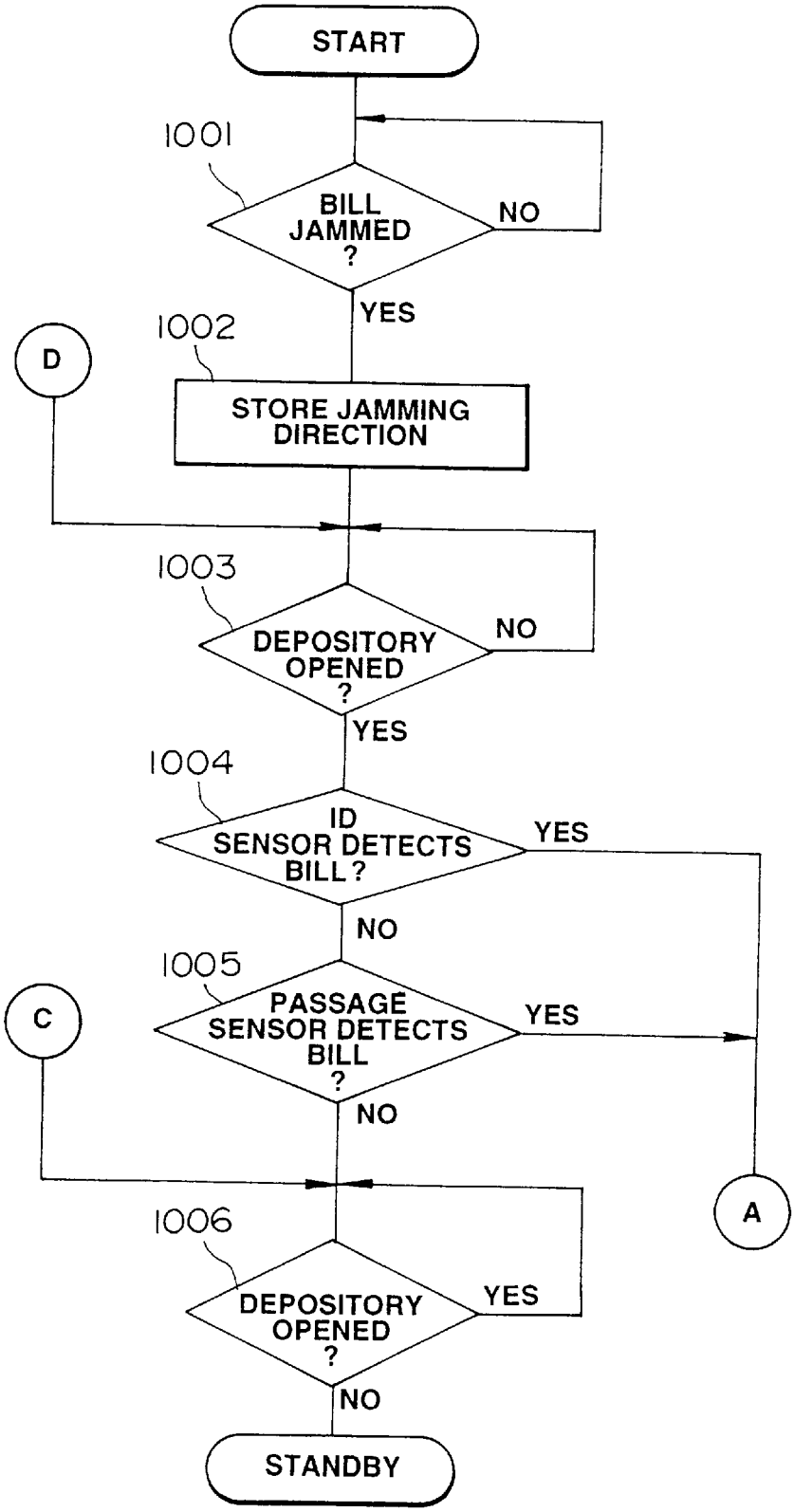
FIGS. 30 through 32 are flow charts illustrating the details of the processing performed if bill jamming has occurred in this embodiment.

In FIG. 30, it is first checked (step 1001) (by the control unit 100) whether it has been established that a bill has jammed, and if it established that bill jamming has occurred, information concerning the direction in which the bill is jammed at this time will be stored (step 1002) in the bill jamming direction memory unit 100*c*.

It is then checked (step 1003) on the basis of the detection output from the bill depository opening and closing detection sensor 920 whether the stacker (bill depository) 90 has been opened in order to remove the jammed bill. When it is established under these conditions that the stacker (bill depository) 90 has been opened, it is then checked (step 1004) on the basis of the detection output from the identification sensor 900 whether there is a bill, and if it is established under these conditions that there is no bill, the presence or absence of a bill is then checked (step 1005) based on the detection output of the passage sensor 910.

If it is established during step 1005 that there is no bill, then no bill is present in the bill conveying channel 400, so closure of the stacker (bill depository) 90 is awaited (step 1006), and standby mode is assumed.

Figure 31:
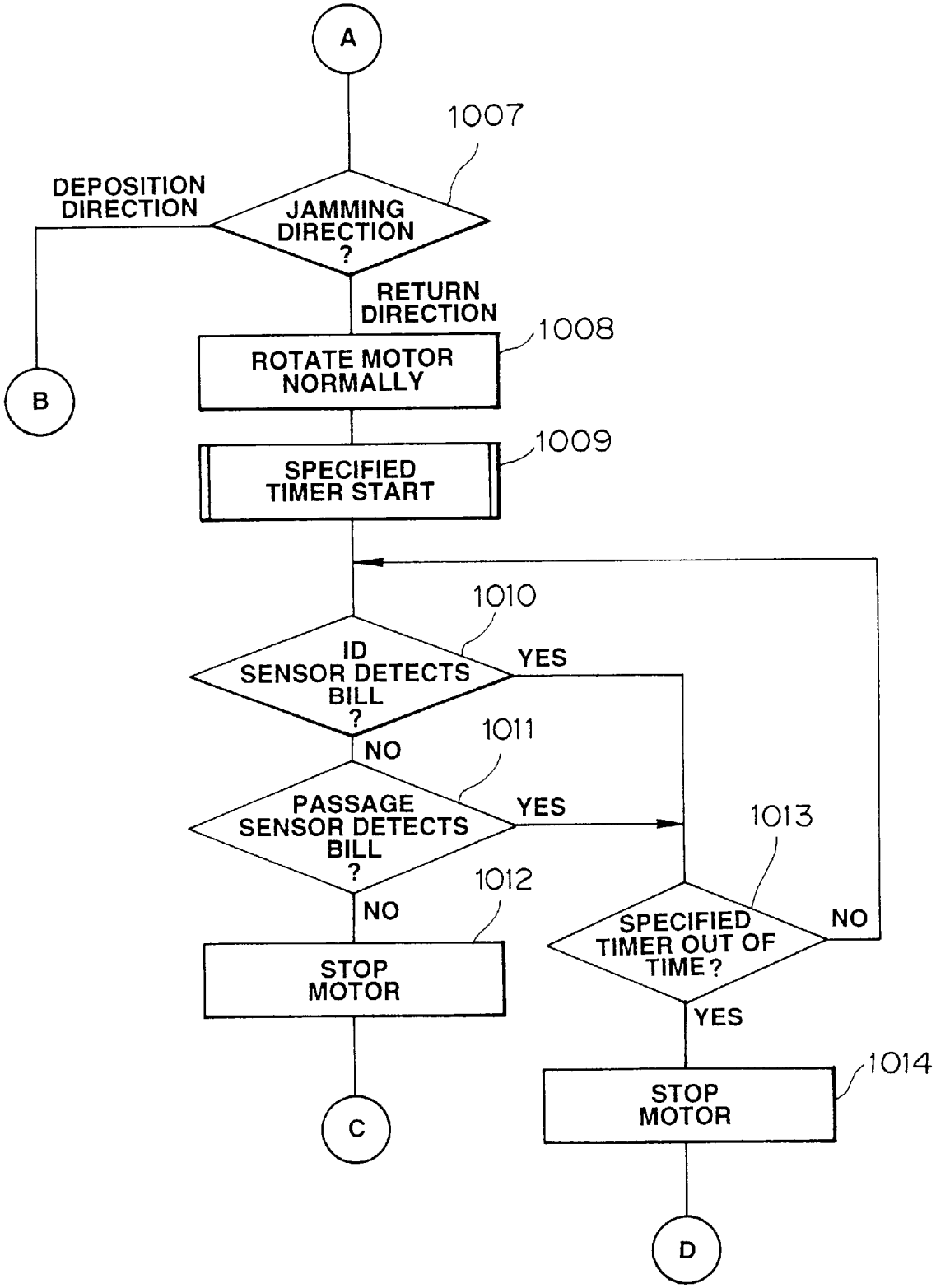

In addition, if the presence of a bill is determined as a result of the decision-making operations performed during step 1004 or step 1005, it is then concluded that a bill has jammed in the bill conveying channel 400, so the operation proceeds to step 1007 shown in FIG. 31.

Based on the data stored in the bill jamming direction memory unit 100*c*, it is checked during step 1007 shown in FIG. 31 whether the bill jamming direction coincides with the bill insertion direction or the bill return direction (step 1007). If the bill jamming direction coincides with the bill return direction under these conditions, the bill conveying motor 50 is rotated normally (step 1008), and a specified timer (not shown) is started (step 1009). The presence or absence of a bill is then established (step 1010) based on the detection output of the identification sensor 900, and if it has been concluded that there is no bill under these conditions, the presence or absence of a bill is then checked (step 1011) based on the detection output of the passage sensor 910.

If it has been established during step 1011 that there is no bill, the bill conveying motor 50 is stopped (step 1012) on the assumption that the bill that has jammed in the bill conveying channel 400 has been ejected through the stacker 90, the operation proceeds to the step 1006 in FIG. 30, the closure of the stacker (bill depository) 90 is awaited, and standby mode is assumed.

If the decision-making operations performed during step 1010 or step 1011 reveal the presence of a bill, it is checked (step 1013) whether the time set on the specified timer started during step 1009 has elapsed. If the time has not elapsed, the operation returns to step 1010, and if the time has elapsed, the bill conveying motor 50 is stopped (step 1014), and the operation proceeds to step 1003 shown in FIG. 30.

Figure 32:
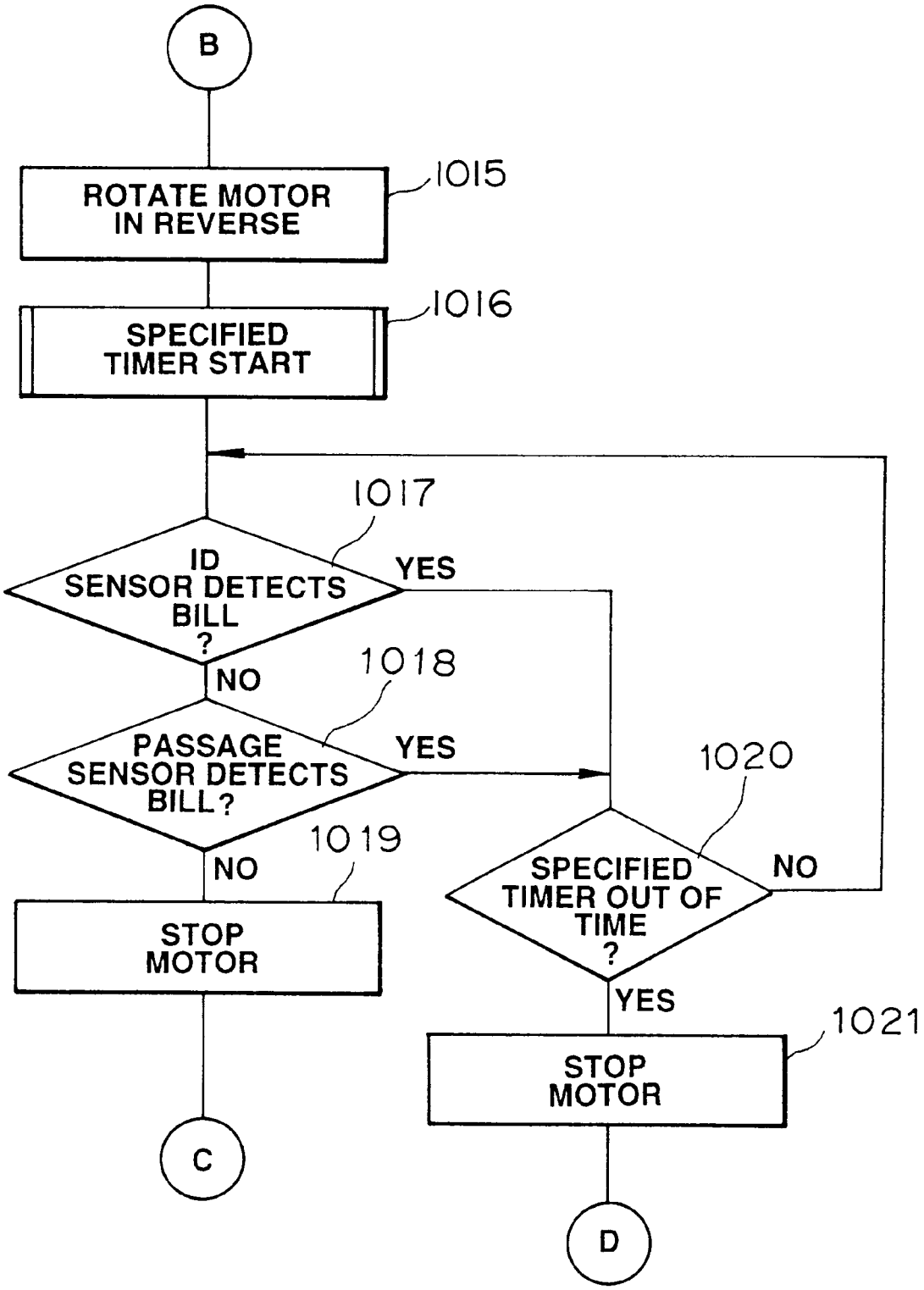

The operation proceeds to step 1015 shown in FIG. 32 if it is determined during step 1007 shown in FIG. 31 and on the basis of the data stored in the bill jamming direction memory unit 100*c* that the bill jamming direction coincides with the bill insertion direction.

During step 1015 shown in FIG. 32, the bill conveying motor 50 is rotated in a reverse direction (step 1015), and a specified timer (not shown) is started (step 1016). It is then checked (step 1017) for the presence or absence of a bill on the basis of the detection output from the identification sensor 900, and if it is established under these conditions that there is no bill, the presence or absence of a bill is then checked (step 1018) based on the detection output of the passage sensor 910.

If it has been established during step 1018 that there is no bill, it is assumed that the bill that has jammed in the bill conveying channel 400 has been ejected through the bill insertion slot 11, the bill conveying motor 50 is stopped (step 1019), the operation proceeds to the step 1003 and the subsequent steps in FIG. 30, the closure of the stacker (bill depository) 90 is awaited, and standby mode is assumed.

If the decision-making operations performed during step 1017 or step 1018 reveal the presence of a bill, it is checked (step 1020) whether the time set on the specified timer started during step 1016 has elapsed. If the time has not elapsed, the operation returns to step 1017, and if the time has elapsed, the bill conveying motor 50 is stopped (step 1021), the operation proceeds to the step 1006 in FIG. 30, the closure of the stacker (bill depository) 90 is awaited, and standby mode is assumed.

In the structure described above, the opening of the stacker (bill depository) 90 conveys the bill jammed in the bill conveying channel in the direction opposite to the direction in which the bill has jammed, although it is also possible to use a structure in which the bill jammed in the bill conveying channel is conveyed in the direction opposite to the bill jamming direction by opening other portions of the bill conveying channel 400.

This embodiment is thus configured in such a way that if a bill has jammed in the bill conveying channel, information concerning the direction in which the bill has jammed is stored in a bill jamming direction memory means, and when the bill that has jammed in the bill conveying channel is to be removed, a bill reverse-direction conveyance control means conveys the bill in the direction opposite to the bill jamming direction stored in the bill jamming direction memory means, making it possible to perform with utmost ease operations involving the removal of bills jammed in the bill conveying channel.

Figure 33:
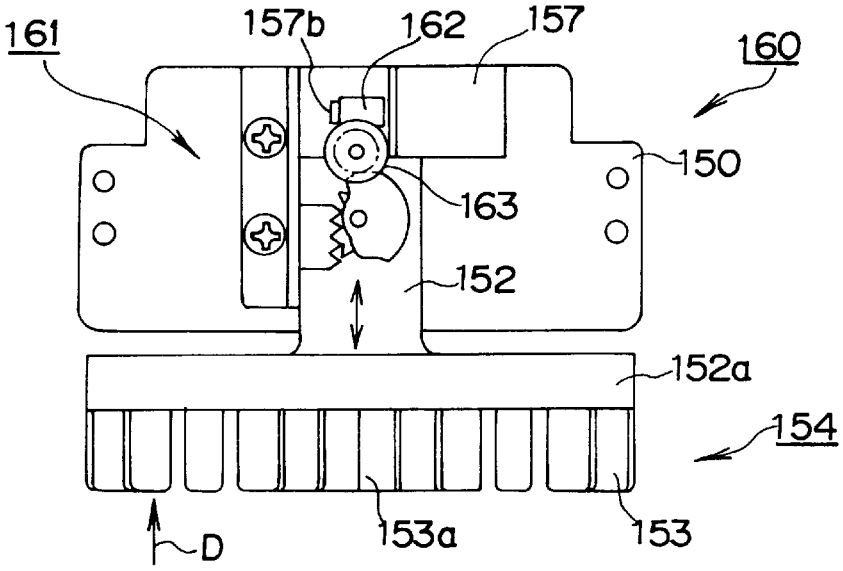
FIG. 33 is a schematic front view of a shutter means used in the bill processing device of this invention.

FIG. 33 is a schematic front view of a shutter means 160 used in the bill processing device of this invention; components that are the same as those described with reference to FIGS. 35 through 39 are designated with identical symbols.

The shutter means 160 according to this invention is such that the gear transmission means 161 that transmits the driving force of a shaft motor 157 comprises a worm 162 that is secured to the drive shaft 157*b* of the shaft motor 157, and a worm wheel 163 that engages the worm gear 162.

Figure 34:
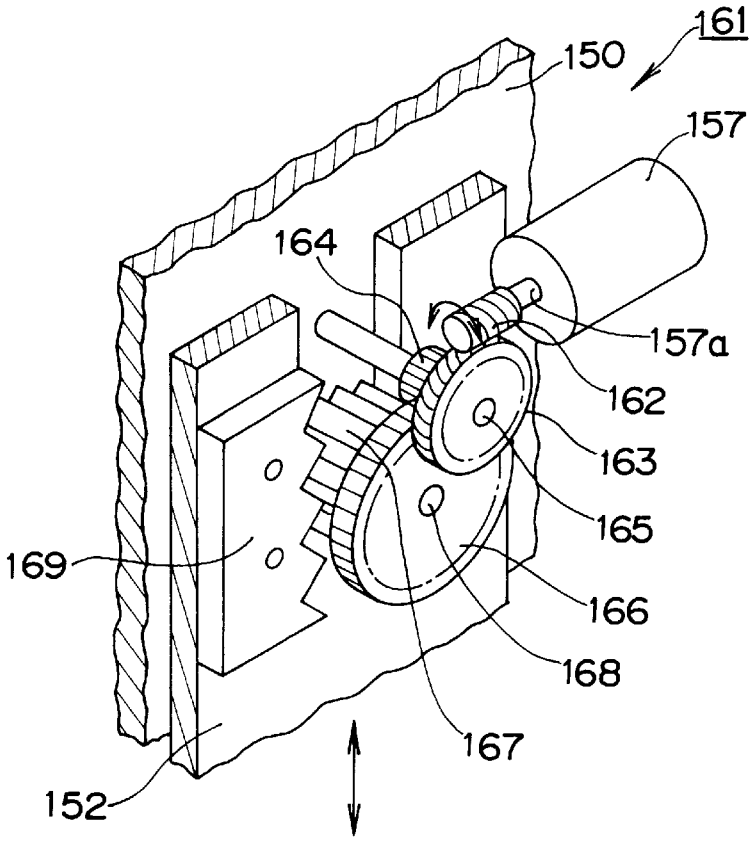
FIG. 34 is a schematic enlarged perspective view of the gear transmission means.
Figure 35:
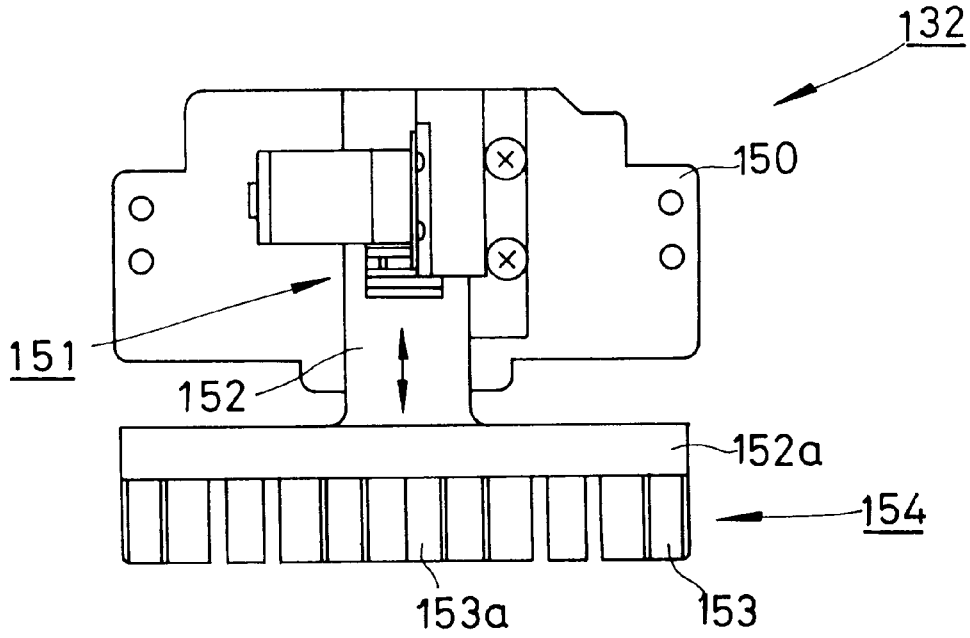
FIG.35 (PRIOR ART)
FIG. 35 is a schematic front view of the shutter means used in a bill processing device.
Figure 36:
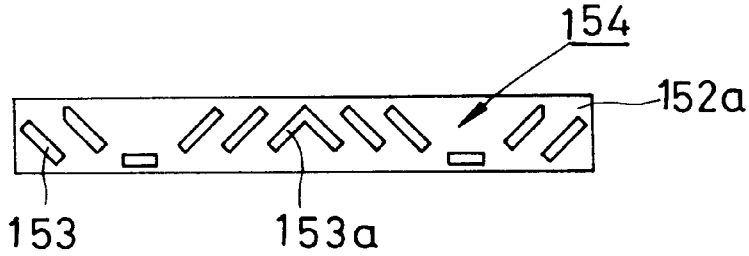
FIG.36 (PRIOR ART)
FIG. 36 is a bottom view of the shutter.
Figure 37:
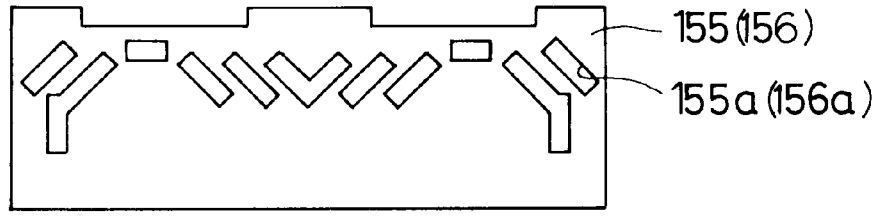
FIG.37 (PRIOR ART)
FIG. 37 is a plan view of the chutes that comprise the bill conveying channel.

On the other hand, as shown in FIG. 34, which is a schematic enlarged oblique view of the main components of the gear transmission means 161, a first spur gear 164 is coaxially secured to the worm wheel 163, and the first spur gear 164 and worm wheel 163 are rotatably supported by a first plate 150 via a shaft 165.

In addition, the aforementioned first spur gear 164 engages a second spur gear 166, which is mounted beneath the worm wheel 163, and a third spur gear 167 is coaxially secured to the second spur gear 166. The third spur gear 167 and second spur gear 166 are rotatably supported by the first plate 150 via a shaft 168.

Meanwhile, a rack 169 is secured to a second plate 152, which constitutes a shutter 154, and the aforementioned third spur gear 167 engages the rack 169.

Figure 38:
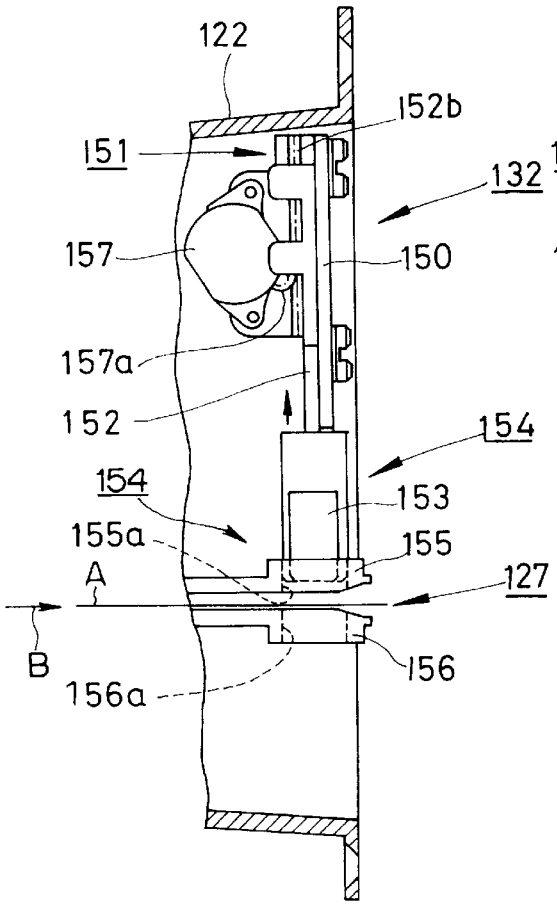
FIG.38 (PRIOR ART)
FIGS. 38 and 39 are schematic side views of the bill conveying channel.

In the gear transmission means 161 with the above-described structure, when the shaft motor 157 is unidirectionally rotated in a manner such as shown in FIG. 34, the driving force thereof is transmitted to the second plate 152 via the worm gear 162, worm wheel 163, first spur gear 164, second spur gear 166, third spur gear 167, and rack 169, with the result that the second plate 152 is pushed upward over a predetermined distance, and the bill conveying channel 127 shown in FIG. 38 is opened, permitting the passage of an inserted bill A inserted in the direction of arrow B.

Figure 39:
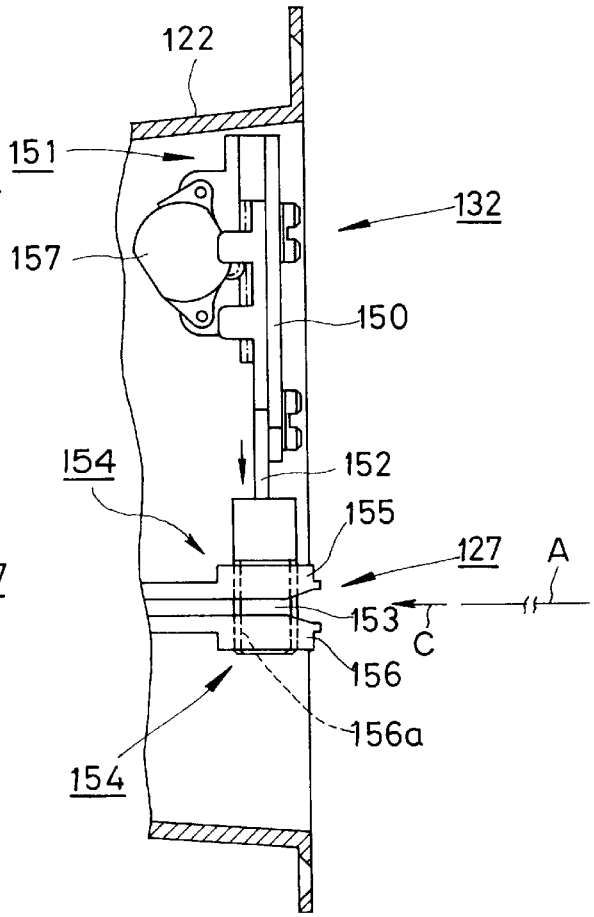
FIG.39 (PRIOR ART)

When, on the other hand, the shaft motor 157 is rotated in the other direction, the driving force thereof is transmitted to the second plate 152 via a gear transmission means 161 along the same route as that described above, whereupon the second plate 152 is pushed downward over a predetermined distance, the bill conveying channel 127 is closed in a manner such as that shown in FIG. 39, and the inserted bill A is thereby prevented from being extracted against the force exerted in the direction of arrow C.

In addition, the shutter means 160 having the aforementioned gear transmission means 161 is such that when a force is applied from the outside in the direction of arrow D in an attempt to forcibly push the second plate 152 upward from the position in which the bill conveying channel is closed, as shown in FIG. 33, the space between the motor 157 and the second plate 152 contains an interposed gear reduction mechanism comprising the worm wheel 163 and the worm gear 162 that has, as shown in FIG. 34, considerable frictional force between the engaged gears and has a high reduction ratio, as viewed from the side of the motor 157. As a result, when an attempt is made to push the second plate 152 upward from the position in which the bill conveying channel is closed, the resulting force is not transmitted because it creates substantial gear resistance between the worm gear 162 and the worm wheel 163, so the motor 157 does not rotate at a proportional pace, making it impossible to move the shutter 154 upward.

Therefore, the second plate 152 that constitutes the shutter 154 cannot be moved upward by an outside force, preventing the outside force from opening the bill conveying channel after the bill conveying channel 127 has been closed by the shutter 154, and thus making it possible to additionally improve the effect whereby the forcible extraction of the inserted bill A is prevented.

The bill processing device of this embodiment is therefore such that the shutter that opens and closes the bill conveying channel is operated with the aid of a gear transmission means comprising a worm gear that is secured to the drive shaft of the shutter motor and a worm wheel that engages the worm gear, so the interposed gear transmission means develops considerable frictional force between the engaged gears and has a low reduction ratio, as seen from the side of the motor, with the result that the gear transmission means develops substantial resistance and the motor does not rotate at a proportional pace even when an attempt is made to use an outside force and to forcibly push the shutter in the opposite direction, that is, to push it upward from the position in which the bill conveying channel is closed, making it possible to prevent shutter movement as much as possible and to additionally enhance the effect whereby the extraction of inserted bills is prevented.

What is claimed is:

1. A bill processing device which intakes bills that have been inserted into a bill insertion slot into a bill conveying channel of the device, identifies authenticity of the intaken bills, holds bills identified as authentic and returns bills identified as not authentic through the bill insertion slot, wherein the bill insertion slot is provided with shutter means, and the shutter means comprises:

a reversible motor;

a shutter for opening and closing the bill conveying channel; and gear transmission means for transmitting a drive force of the shutter motor to the shutter such that rotation of the shutter motor in a first rotational direction conveyed by way of the gear transmission means moves the shutter into a first position which opens the bill conveying channel, and rotation of the shutter motor in a second rotational direction opposite to the first rotational direction conveyed by way of the gear transmission means moves the shutter into a second position which closes the bill conveying channel, the gear transmission means comprises:

a worm gear secured to a drive shaft of the shutter motor;

a worm wheel engaged with the worm gear;

a gear group engaged with the worm wheel; and a rack secured to the shutter and engaged with a last gear of the gear group.

2. The bill processing device as defined in claim 1 wherein the gear group comprises:

a first spur gear secured coaxially to the worm gear and having a smaller diameter than the worm gear;

a second spur gear engaged with the first spur gear and having a larger diameter than the first spur gear; and a third spur gear secured coaxially to the second spur gear and engaged with the rack.

* * * * *